US006338927B1

(12) United States Patent
Inagaki et al.

(10) Patent No.: US 6,338,927 B1
(45) Date of Patent: Jan. 15, 2002

(54) STILBENE DERIVATIVE, METHOD OF PRODUCING THE SAME, AND ELECTROPHOTOSENSITIVE MATERIAL USING THE SAME

(75) Inventors: Yoshio Inagaki; Yukimasa Watanabe, both of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/648,078

(22) Filed: Aug. 25, 2000

(30) Foreign Application Priority Data

Sep. 29, 1999 (JP) ..... 11-277048

(51) Int. Cl.[7] ..... G03G 5/06
(52) U.S. Cl. ..... 430/73; 430/83; 564/434
(58) Field of Search ..... 564/434; 430/72, 430/73

(56) References Cited

U.S. PATENT DOCUMENTS 6,143,889 A * 11/2000 Metzger et al. ..... 544/193.2
6,177,220 B1 * 1/2001 Watanabe et al. ..... 430/73

FOREIGN PATENT DOCUMENTS

| | | |
|---|---|---|
| JP | 50-31773 | 3/1975 |
| JP | 05-150482 A | 6/1993 |
| JP | 05-150491 A | 6/1993 |
| JP | 06-130694 A | 5/1994 |
| JP | 7-244389 | 9/1995 |
| JP | 07-325414 A | 12/1995 |

* cited by examiner

*Primary Examiner*—John Goodrow
(74) *Attorney, Agent, or Firm*—Smith, Gambrell & Russell, LLP

(57) ABSTRACT

The present invention relates to a novel stilbene derivative, which is a stilbene compound wherein molecular structures of triphenylamino groups located at both sides of a benzene ring in a molecular center are unsymmetric, and an electrophotosensitive material having high sensitivity and improved repeatability, comprising a conductive substrate and a photosensitive layer formed on the substrate, the photosensitive layer containing the derivative.

19 Claims, 5 Drawing Sheets

STILBENE DERIVATIVE, METHOD OF PRODUCING THE SAME, AND ELECTROPHOTOSENSITIVE MATERIAL USING THE SAME

BACKGROUND OF THE INVENTION

The present invention relates to a stilbene derivative having high compatibility with a binder resin, high sensitivity and excellent stability, a method of producing the same, and an electrophotosensitive material containing the stilbene derivative used in image forming apparatuses such as electrostatic copying machine, facsimile and laser beam printer.

In the image forming apparatuses, various organic photosensitive materials having the sensitivity within a wavelength range of a light source used in the apparatus are used. Recently, the organic photosensitive material has widely been used because it is easily produced as compared with a conventional inorganic photosensitive material and that it has advantages such as wide range of choice of photosensitive materials such as electric charge transferring material, electric charge generating material and binder resin, and high functional design freedom.

The organic photosensitive material includes a single-layer type photosensitive material wherein an electric charge transferring material and an electric charge generating material are dispersed in the same photosensitive layer, and a multi-layer type photosensitive material comprising an electric charge generating layer containing an electric charge generating material and an electric charge transferring layer containing an electric charge transferring material, which are mutually laminated.

Japanese Published Unexamined Patent Application (Kokai Tokkyo Koho Sho) No. 50-31773 and Japanese Published Unexamined Patent Application (Kokai Tokkyo Koho Hei) No. 7-244389 disclose a stilbene derivative as the electric charge transferring material used in the organic photosensitive material.

However, the stilbene derivative disclosed in the above patent applications is not uniformly dispersed in the photosensitive layer and charge transfer hardly occurs because of its poor compatibility with a binder resin. Therefore, the stilbene derivative itself has high charge mobility. However, when using the stilbene derivative as the electric charge transferring material in the photosensitive material, its characteristics can not be sufficiently exhibited so that the residual potential of the photosensitive material increases and the sensitivity to light becomes insufficient.

SUMMARY OF THE INVENTION

An object of the present invention is to solve the technical problems described above and to provide a novel stilbene derivative suited for use as an electric charge transferring material of an electrophotosensitive material, and a method of producing the same.

Another object of the present invention is to provide an electrophotosensitive material having improved sensitivity and repeatability as compared with a conventional electrophotosensitive material.

To attain the objects described above, the present inventors has studied intensively and found the following fact. Among the stilbene derivative, a compound, wherein molecular structures of triphenylamino groups located at both sides of a benzene ring in a molecular center are unsymmetric with respect to the benzene ring, is superior in compatibility with a binder resin to a conventional stilbene derivative and has a large charge mobility. Thus, the present invention has been completed.

That is, the present invention is directed to a stilbene derivative, a method of preparing the same, and an electrophotosensitive material using the same.

1. A stilbene derivative wherein molecular structures of triphenylamino groups located at both sides of a benzene ring in a molecular center are unsymmetric with respect to the benzene ring.

2. The stilbene derivative according to the term 1, which is represented by the general formula (1):

(1)

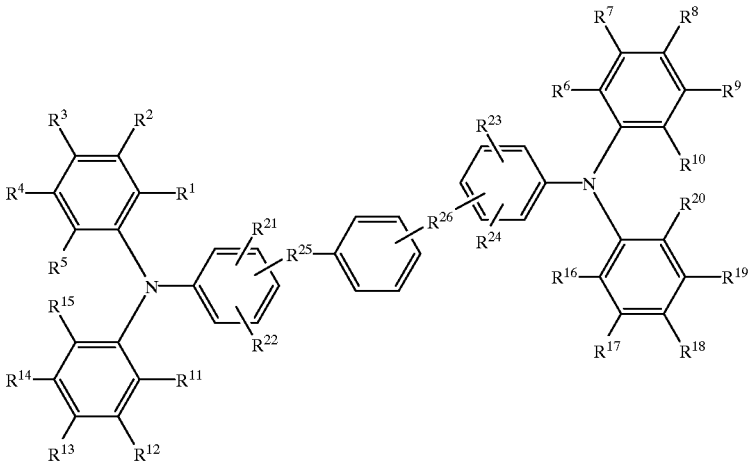

wherein $R^1$ to $R^{24}$ are the same or different and each represents an optionally substituted alkyl group, an optionally substituted alkoxy group, an optionally substituted aryl group, an optionally substituted aralkyl group, a hydrogen atom, or a nitro group; $R^{25}$ and $R^{26}$ each represents a vinylene group; at least one of the pairs of a combination of $R^n$ and $R^{n+5}$ and a combination of $R^m$+$R^{m+2}$ represent different substituents; at least two substituents of the group consisting of $R^1$ to $R^5$, $R^6$ to $R^{10}$ $R^{11}$ to $R^{15}$, and $R^{16}$ to $R^{20}$ represent a hydrogen atom; n represents an integer of 1 to 10; and m represents 21 or 22.

3. The stilbene derivative according to the term 2, wherein at least one of the pairs of $R^{21}$ and $R^{23}$, $R^{22}$ and $R^{24}$, and $R^{25}$ and $R^{26}$ represent different substitution positions from that of a nitrogen atom attached through a benzene ring.

4. The stilbene derivative according to the term 2, wherein at least one of $R^1$, $R^6$, $R^{11}$ and $R^{16}$ represent an optionally substituted alkyl group, an optionally substituted alkoxy group, an optionally substituted aryl group, and an optionally substituted aralkyl group.

5. The stilbene derivative according to the term 1, which is represented by the general formula (2):

(2)

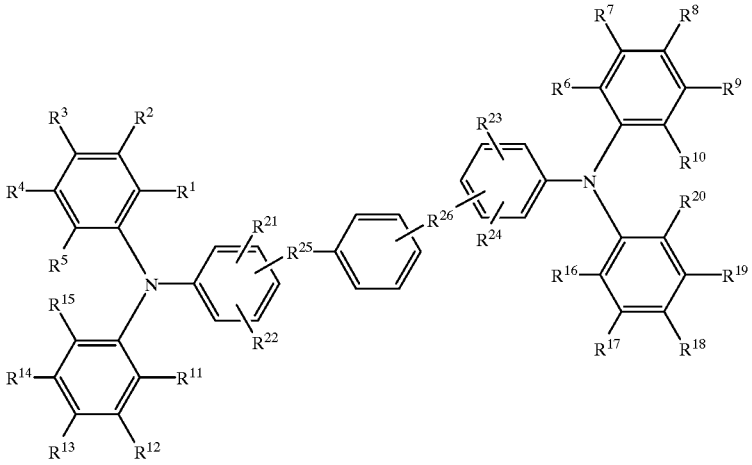

wherein $R^1$ to $R^{24}$ are the same or different and each represents an optionally substituted alkyl group, an optionally substituted alkoxy group, an optionally substituted aryl group, an optionally substituted aralkyl group, a hydrogen atom, or a nitro group; $R^{25}$ and $R^{26}$ each represents a vinylene group; $R^n$ and $R^{n+5}$ each represents the same group; $R^m$ and $R^{m+2}$ each represents the same group; at least one of the pairs of $R^{21}$ and $R^{23}$, $R^{22}$ and $R^{24}$, and $R^{25}$ and $R^{26}$ represent different substitution positions from that of a nitrogen atom attached through a benzene ring; n represents an integer of 1 to 10; and m represents 21 or 22.

6. The stilbene derivative according to the term 5, wherein at least one of $R^1$, $R^6$, $R^{11}$ and $R^{16}$ is an optionally substituted alkyl group, an optionally substituted alkoxy group, an optionally substituted aryl group, or an optionally substituted aralkyl group.

7. A method of producing the stilbene derivative of the term 2, which comprises reacting an aldehyde derivative represented by the general formula (3):

(3)

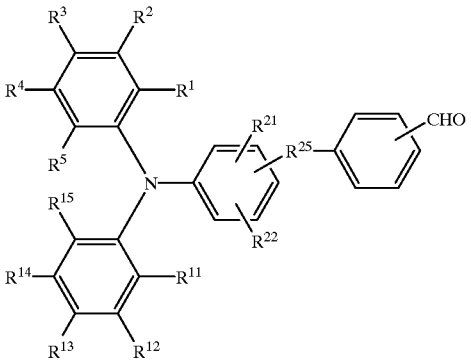

wherein $R^1$ to $R^5$, $R^{11}$ to $R^{15}$, $R^{21}$, $R^{22}$ and $R^{25}$ are as defined in the general formula (1), with a triphenylamine phosphate derivative represented by the general formula (4):

(4)

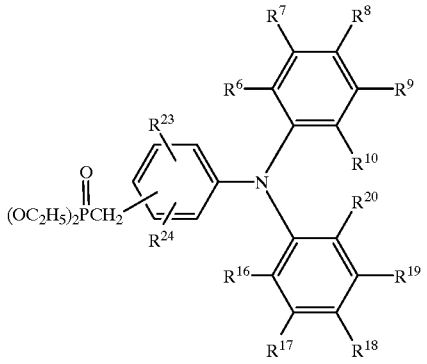

wherein $R^6$ to $R^{10}$, $R^{16}$ to $R^{20}$, $R^{23}$ and $R^{24}$ are as defined in the general formula (1).

8. A method of producing the stilbene derivative of the term 2, which comprises reacting a formylated triphenylamine derivative represented by the general formula (5):

(5)

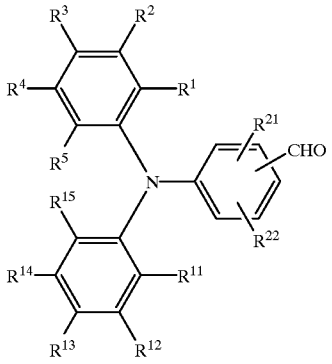

wherein $R^1$ to $R^5$, $R^{11}$ to $R^{15}$, $R^{21}$ and $R^{22}$ are as defined in the general formula (1), with a monostilbene derivative represented by the general formula (6):

(6)

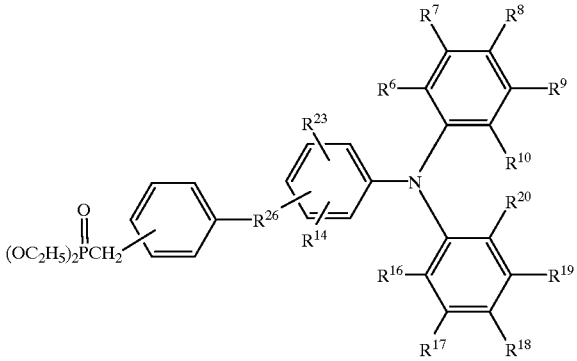

wherein $R^6$ to $R^{10}$, $R^{16}$ to $R^{20}$, $R^{23}$, $R^{24}$ and $R^{26}$ are as defined in the general formula (1).

9. A method of producing the stilbene derivative of the term 5, which comprises reacting an aldehyde derivative represented by the general formula (3):

(3)

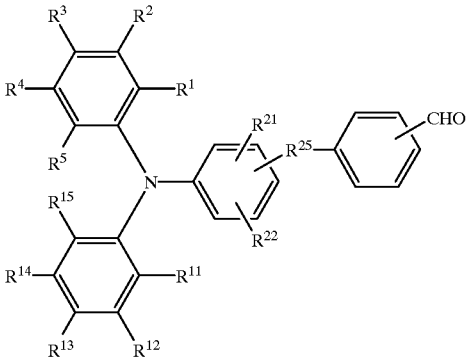

wherein $R^1$ to $R^5$, $R^{11}$ to $R^{15}$, $R^{21}$, $R^{22}$ and $R^{25}$ are as defined in the general formula (1), with a triphenylamine phosphate derivative represented by the general formula (4):

(4)

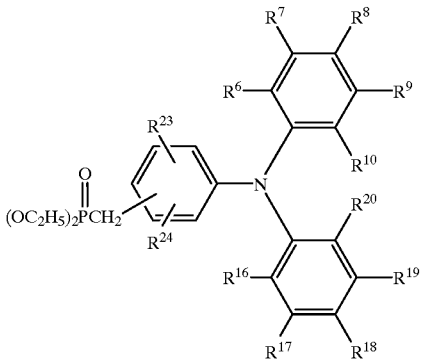

wherein $R^6$ to $R^{10}$, $R^{16}$ to $R^{20}$, $R^{23}$ and $R^{24}$ are as defined in the general formula (1).

10. A method of producing the stilbene derivative of the term 5, which comprises reacting a formylated triphenlamine derivative represented by the general formula (5):

(5)

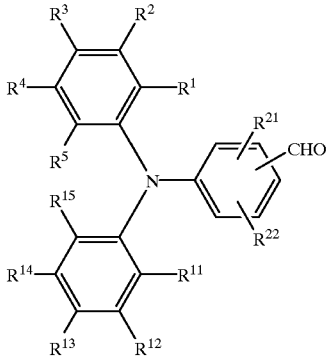

wherein $R^1$ to $R^5$, $R^{11}$ to $R^{15}$, $R^{21}$ and $R^{22}$ are as defined in the general formula (1), with a monostilbene derivative represented by the general formula (6):

(6)

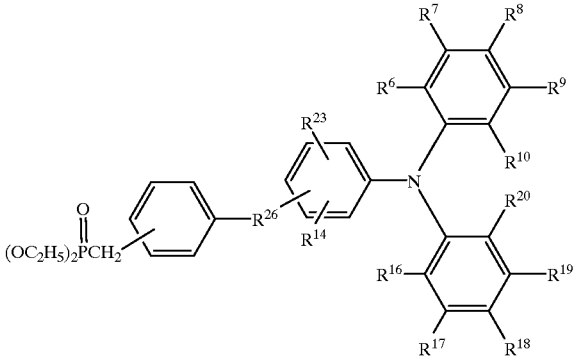

wherein $R^6$ to $R^{10}$, $R^{16}$ to $R^{20}$, $R^{23}$, $R^{24}$ and $R^{26}$ are as defined in the general formula (1).

11. An electrophotosensitive material comprising a conductive substrate and a photosensitive layer formed on the substrate, the photosensitive layer containing at least one of the stilbene derivatives of the term 1.

12. An electrophotosensitive material comprising a conductive substrate and a photosensitive layer formed on the substrate, the photosensitive layer containing at least one of the stilbene derivatives of the term 2.

13. An electrophotosensitive material comprising a conductive substrate and a photosensitive layer formed on the substrate, the photosensitive layer containing at least one of the stilbene derivatives of the term 3.

14. The electrophotosensitive material according to the term 11, wherein the photosensitive layer is a single-layer type photosensitive layer containing an electric charge generating material.

15. The electrophotosensitive material according to the term 12, wherein the photosensitive layer is a single-layer type photosensitive layer containing an electric charge generating material.

16. The electrophotosensitive material according to the term 13, wherein the photosensitive layer is a single-layer type photosensitive layer containing an electric charge generating material.

17. The electrophotosensitive material according to the term 14, wherein the electric charge generating material is one or more member selected from the group consisting of a metal-free phthalocyanine, a metal phthalocyanine, a perylene pigment and a bisazo pigment.

18. The electrophotosensitive material according to the term 15, wherein the electric charge generating material is one or more member selected from the group consisting of a metal-free phthalocyanine, a metal phthalocyanine, a perylene pigment and a bisazo pigment.

19. The electrophotosensitive material according to the term 16, wherein the electric charge generating material is one or more member selected from the group consisting of a metal-free phthalocyanine, a metal phthalocyanine, a perylene pigment and a bisazo pigment.

In the present invention, the stilbene derivative represented by the general formula (1) or (2) is a particularly preferable compound when using in the photosensitive layer of the electrophotosensitive material because of its excellent compatibility with a binder resin and large charge mobility.

The stilbene derivative represented by the general formula (1) or (2) is a novel compound which is not disclosed in Japanese Published Unexamined Patent Application (Kokai Tokkyo Koho Sho) No. 50-31773 and Japanese Published Unexamined Patent Application (Kokai Tokkyo Koho Hei) No. 7-244389, and is characterized in that molecular structures of triphenylamino groups located at both sides of a benzene ring in a molecular center are unsymmetric with respect to the benzene ring. In addition, the compound has a higher compatibility with a binder resin than that of the compounds disclosed specifically in the above patent applications, and has a high charge mobility.

Therefore, an electrophotosensitive material having high sensitivity and improved repeatability can be obtained by using the stilbene derivative (1) or (2) as the electric charge (hole) transferring material in the electrophotosensitive material. The stilbene derivative, wherein at least one of $R^1$, $R^6$, $R^{11}$ and $R^{16}$ is an optionally substituted alkyl, an optionally substituted alkoxy group, an optionally substituted aryl group, or optionally substituted an aralkyl group, has good compatibility with a binder resin because of its poor symmetry of the molecule, and it is particularly preferred.

The stilbene derivatives (1) and (2) can be obtained by the production method described in the term 7 (hereinafter referred to as a production method (A)) or the production method described in the term 8 (hereinafter referred to as a production method (B)).

The electrophotosensitive material of the present invention is an electrophotosensitive material comprising a conductive substrate and a photosensitive layer formed on the substrate, the photosensitive layer containing at least one of the stilbene derivatives represented by the general formulas (1) and (2).

As described above, since the stilbene derivative represented by the general formula (1) or (2) is contained in the photosensitive layer, the electrophotosensitive material of the present invention is superior in sensitivity to light on charging and exposure because of its high speed of transferring electric charges (holes) generated in the electric charge generating material, that is, large charge mobility. As a result, according to the electrophotosensitive material of the present invention, the sensitivity is higher than that in case where a conventional stilbene derivative is used as a hole transferring material, and the repeatability is improved.

The photosensitive layer is preferably a single-layer type photosensitive layer containing at least one of the stilbene derivatives represented by the general formulas (1) and (2), and an electric charge generating material and an electron transferring material.

The electrophotosensitive material of the present invention has a specific operation and effect capable of contributing to attain high speed and high performance of various image forming apparatuses such as electrostatic copying machine and laser printer, because of the above features.

DISCLOSURE OF THE INVENTION

Figure 1:
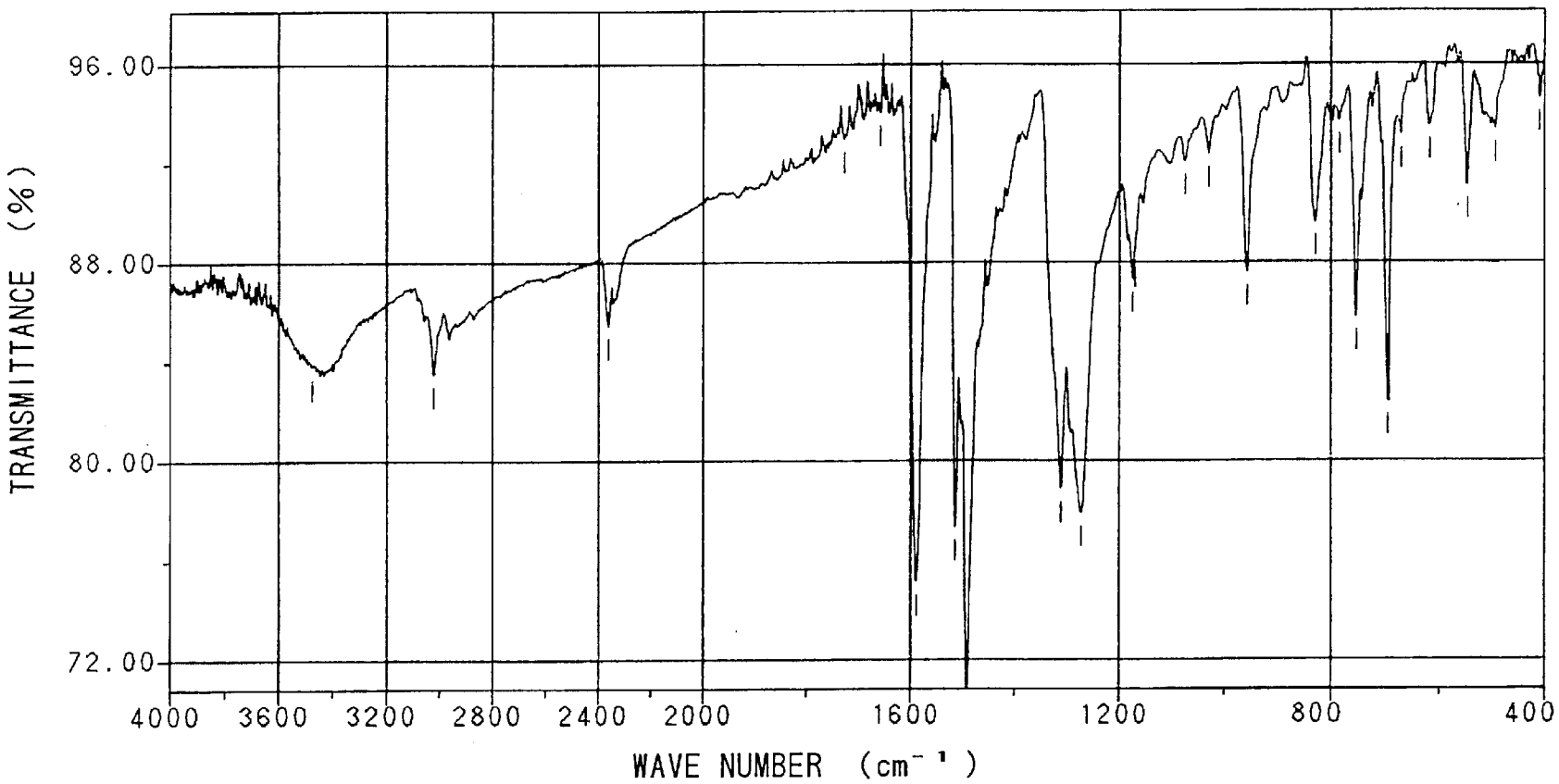
FIG. 1 is a graph showing an infrared absorption spectrum of a quinone derivative corresponding to the compound (1-29) in Table 1.
Figure 2:
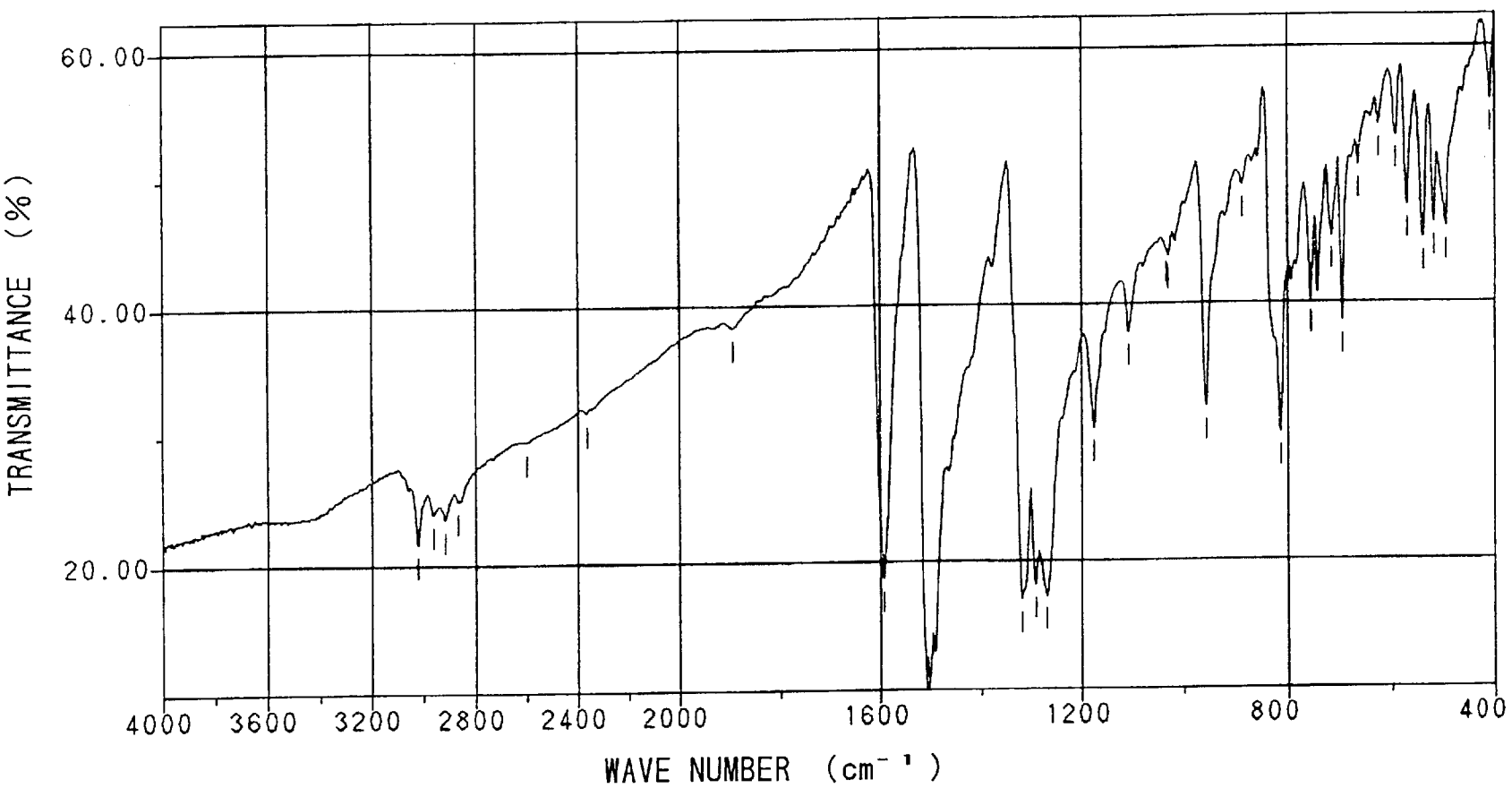
FIG. 2 is a graph showing an infrared absorption spectrum of a quinone derivative corresponding to the compound (1-23) in Table 1.
Figure 3:
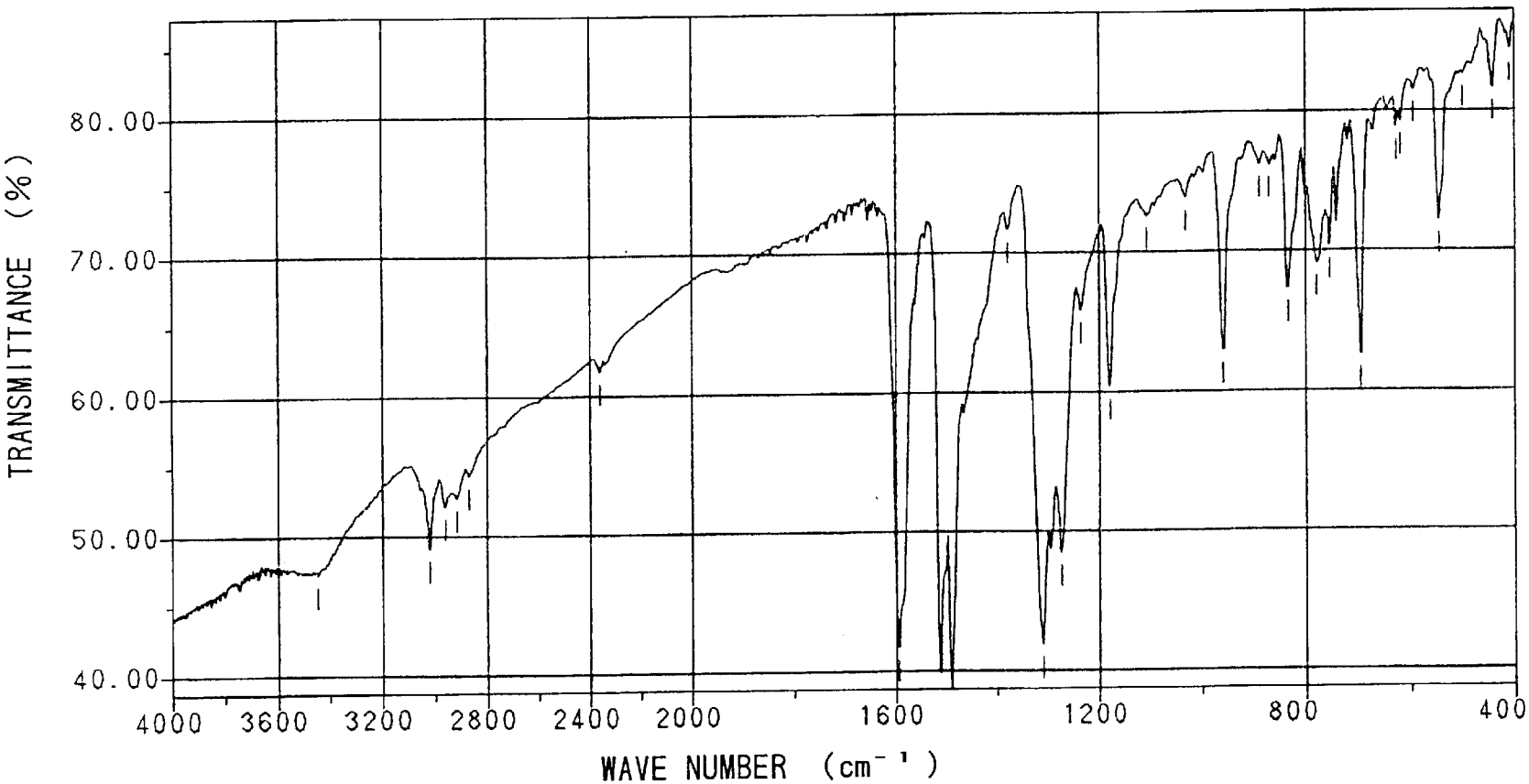
FIG. 3 is a graph showing an infrared absorption spectrum of a quinone derivative corresponding to the compound (1-30) in Table 1.
Figure 4:
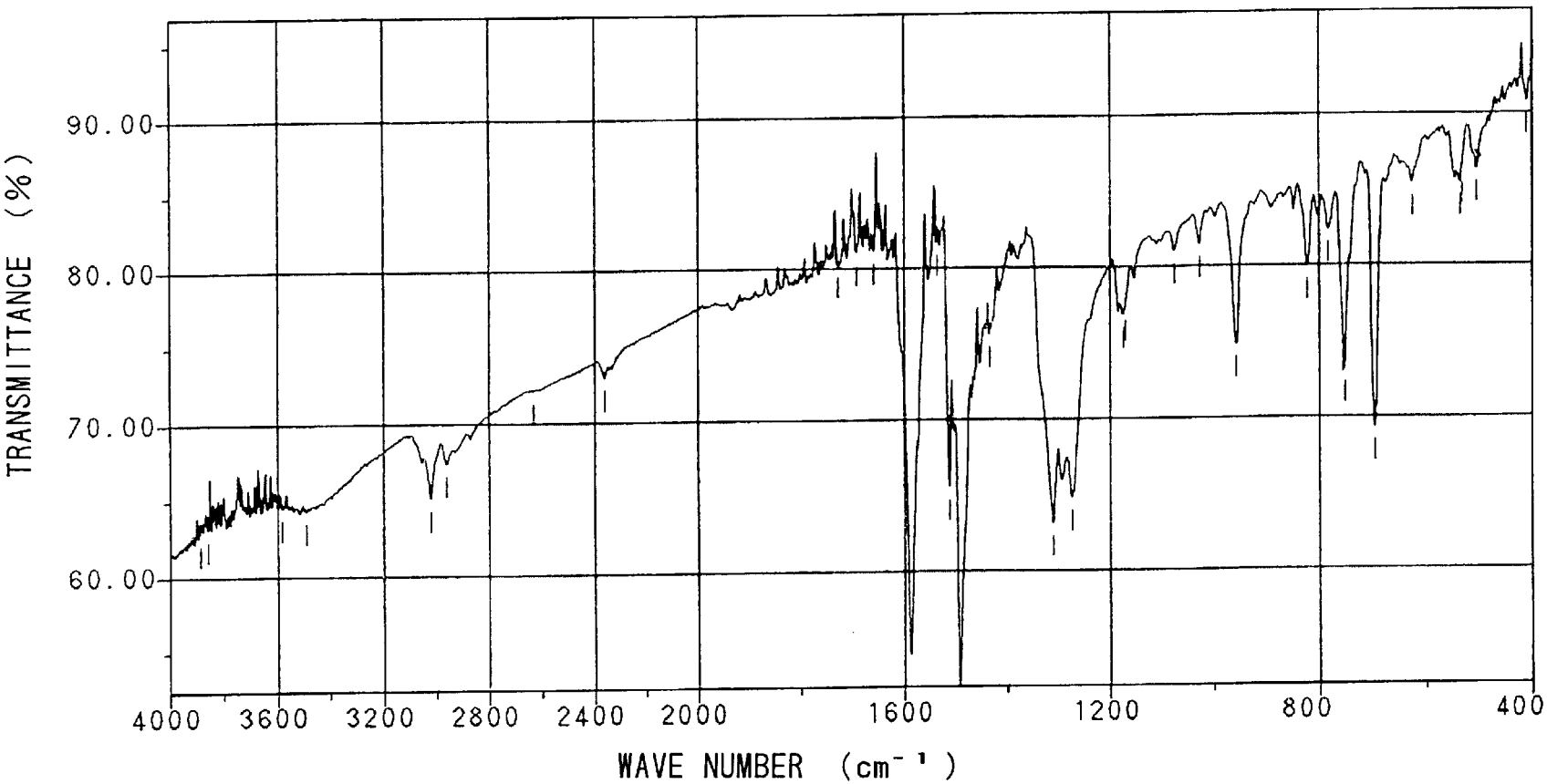
FIG. 4 is a graph showing an infrared absorption spectrum of a quinone derivative corresponding to the compound (1-22) in Table 1.
Figure 5:
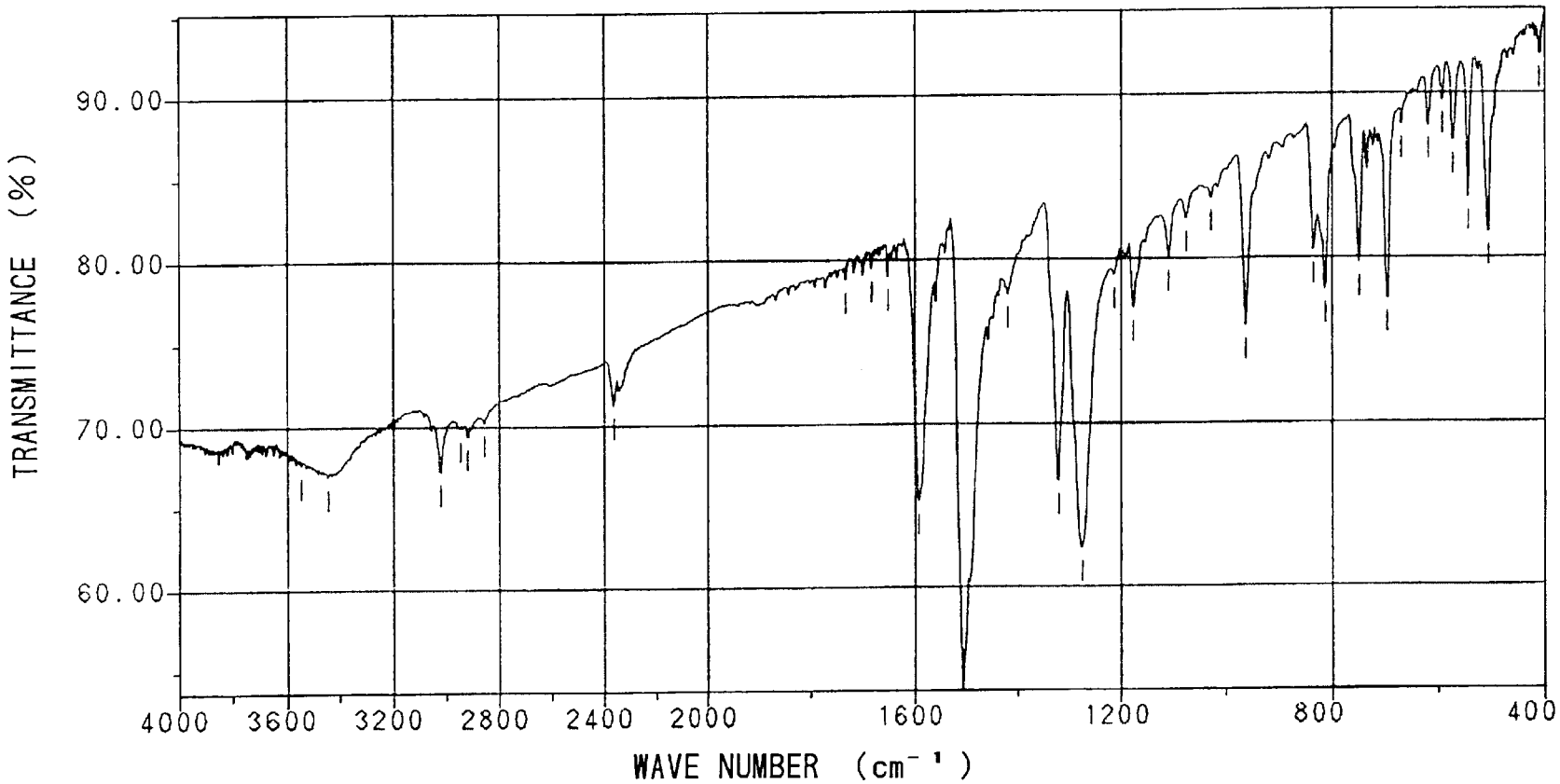
FIG. 5 is a graph showing an infrared absorption spectrum of a quinone derivative corresponding to the compound (1-2) in Table 1.

The stilbene derivative of the present invention will be described in detail by way of the compound represented by the general formula (1) or (2).

In the general formula (1) or (2), an alkyl group corresponding to $R^1$ to $R^{24}$ includes, for example, alkyl groups having 1 to 6 carbon atoms, such as methyl, ethyl, n-propyl, isopropyl, n-butyl, isobutyl, s-butyl, t-butyl, pentyl, isopentyl, neopentyl and hexyl. Among these alkyl groups, alkyl groups having 1 to 4 carbon atoms, such as methyl, ethyl, n-propyl, isopropyl, n-butyl, isobutyl, s-butyl and t-butyl are preferred.

The alkyl group corresponding to $R^1$ to $R^{24}$ may have one or more of substituent. Specific examples thereof include hydroxyalkyl group, alkoxyalkyl group, monoalkylaminoalkyl group, dialkylaminoalkyl group, halogen-substituted alkyl group, alkoxycarbonylalkyl group, carboxyalkyl group, alkanoyloxyalkyl group and aminoalkyl group. In the stilbene derivative (1) or (2) of the present invention, an alkyl group having an electron donative group, such as alkoxy group, monoalkylamino group, amino group and dialkylamino group is preferred as a substituent in view of enhancement of the charge mobility.

Examples of the hydroxyalkyl group include hydroxyalkyl groups whose alkyl moiety has 1 to 6 carbon atoms, such as hydroxymethyl, 2-hydroxyethyl, 1,1-dimethyl-2-hydroxyethyl, 3-hydroxypropyl, 4-hydroxybutyl, 2-hydroxybuthyl, 1-hydroxypenthyl and 6-hydroxyhexyl.

Examples of the alkoxyalkyl group include alkoxyalkyl groups such as methoxymethyl, methoxyethyl, methoxybutyl, ethoxyhexyl, ethoxymethyl, butoxyethyl, t-butoxyhexyl and hexyloxymethyl.

Examples of the monoalkylaminoalkyl group include alkylaminoalkyl groups whose alkyl moiety has 1 to 6 carbon atoms , such as methylaminomethyl, ethylaminomethyl, hexylaminomethyl, ethylaminoethyl, hexylaminoethyl, methylaminopropyl, butylaminopropyl, methylaminobutyl, ethylaminobutyl, hexylaminobutyl, methylaminohexyl, ethylaminohexyl, butylaminohexyl and hexylaminohexyl.

Examples of the dimethylaminoalkyl group include dialkylaminoalkyl groups whose alkyl moiety has 1 to 6 carbon atoms, such as dimethylaminomethyl, diethylaminomethyl, dihexylaminomethyl, diethylaminoethyl, dihexylaminoethyl, dimethylaminopropyl, dibutylaminopropyl, dimethylaminobutyl, diethylaminobutyl, dihexylaminobutyl, dimethylaminohexyl, diethylaminohexyl, dibutylaminohexyl and dihexylaminohexyl.

Examples of the alkoxycarbonylalkyl group include alkoxycarbonylalkyl groups whose alkyl moiety and alkoxy moiety have 1 to 6 carbon atoms, such as methoxycarbonylmethyl, methoxycarbonylethyl, methoxycarbonylhexyl, ethoxycarbonylmethyl, ethoxycarbonylethyl, propoxycarbonylmethyl, isopropoxycarbonylmethyl, butoxycarbonylmethyl, pentyloxycarbonylmethyl, hexylcarbonylmethyl, hexylcarbonylbutyl and hexylcarbonylhexyl.

Examples of the carboxyalkyl group include carboxyalkyl group whose alkyl moiety has 1 to 6 carbon atoms, such as carboxymethyl, carboxyethyl, carboxybutyl, carboxyhexyl and 1-methyl-2-carboxyethyl.

Examples of the halogen-substituted alkyl group include alkyl groups having 1 to 6 carbon atoms substituted with 1 to 3 halogen atoms, such as monochloromethyl, monobromomethyl, monoiodemethyl, monofluoromethyl, dichloromethyl, dibromomethyl, diiodemethyl, difluoromethyl, trichloromethyl, tribromomethyl, triiodemethyl, trifluoromethyl, monochloroethyl, monobromoethyl, monoiodeethyl, monofluoroethyl, dibromobutyl, diiodebutyl, difluorobutyl, chlorohexyl, bromohexyl, iodehexyl and fluorohexyl.

Examples of the alkanoyloxyalkyl group include alkanoyloxy groups containing an alkanoyl moiety having 2 to 6 carbon atoms and an alkyl moiety having 1 to 6 carbon atoms, such as acetoxymethyl, 2-acetoxyethyl, propyonyloxymethyl and 1-hexanoyloxy-2-methylpenthyl.

Examples of the aminoalkyl group include aminoalkyl groups whose alkyl moiety has 1 to 6 carbon atoms, such as aminomethyl, aminoethyl, aminopropyl, aminobutyl and aminohexyl.

Examples of the alkoxy group corresponding to $R^1$ to $R^{24}$ include alkoxy groups having 1 to 6 carbon atoms, such as methoxy, ethoxy, propoxy, isopropoxy, butoxy, t-butoxy, pentyloxy and hexyloxy. The alkoxy group corresponding to $R^1$ to $R^{24}$ may have one or more of substituent. The substituent includes, for example, the same substituent as in the case of the alkyl group, such as halogen atom, amino group, hydroxy group, carboxy group and alkanoyloxy group.

Examples of the aryl group corresponding to $R^1$ to $R^{24}$ include groups such as phenyl, naphthyl, anthryl and phenanthryl.

Examples of the aralkyl group corresponding to $R^1$ to $R^{24}$ include aralkyl groups whose alkyl moiety has 1 to 6 carbon atoms, such as benzyl, 1-phenylethyl, 3-phenylpropyl, 4-phenylbutyl, 5-phenylpenthyl and 6-phenylhexyl.

The aryl group and aralkyl group may have one or more of substituent. Examples of the substituent include amino group, hydroxyl group, optionally esterified carboxyl group, cyano group, and the same alkyl group having 1 to 6 carbon atoms which may have a substituent and alkoxy group having 1 to 6 carbon atoms which may have a substituent. Furthermore, the substitution position of these substituents is not specifically limited.

The stilbene derivative of the present invention (1) or (2) includes stilbene derivatives represented by the following general formulas (7) to (9) depending on a difference in substitution position on the central benzene ring. Particularly, the stilbene derivative represented by the general formula (9) is preferably used.

(7)

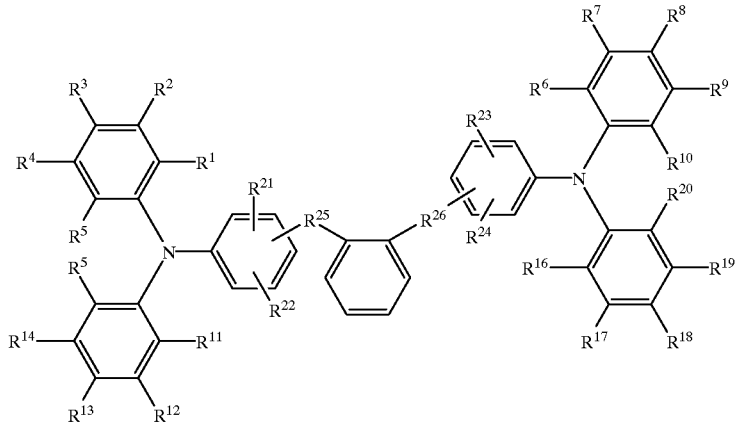

-continued (8)

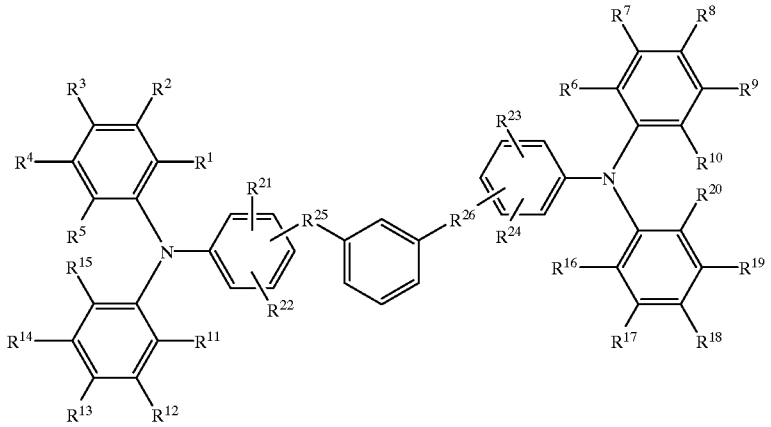

(9)

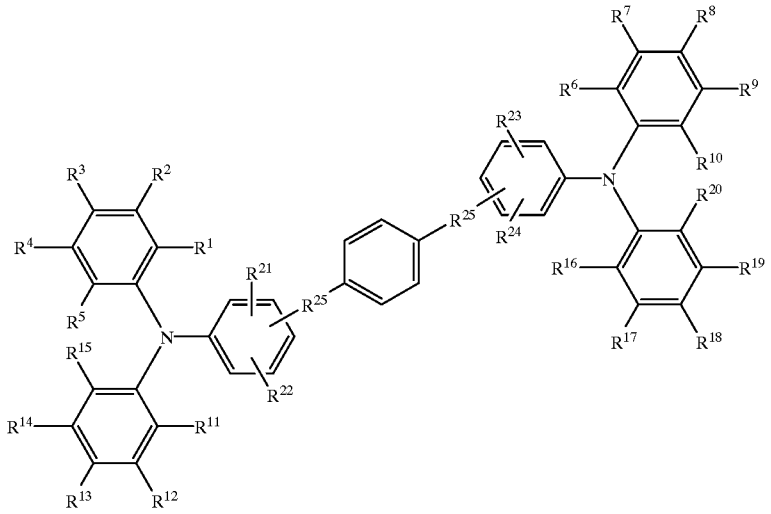

wherein $R^1$ to $R^{26}$ are the same as in the general formula (1) or (2).

The substituents corresponding to $R^1$ to $R^{26}$ are shown in Table 1 below as specific examples of the stilbene derivative represented by the general formula (1) or (2). The respective compounds in Table 1 also include any one of molecular structures of the general formulas (7) to (9).

In Table 1, Me represents a methyl group, Et represents an ethyl group, i-PR represents an isopropyl group, and the numeral attached to the head of the molecular name represents a substitution position to a nitrogen atom attached through a benzene ring. With respect to $R^{25}$ and $R^{26}$ (vinylene group), its represents a substitution position to a nitrogen atom attached through a benzene ring. Groups, which are not shown in the table, represent a hydrogen atom.

TABLE 1

| Compound | Right side of molecule | | Left side of molecule | | $R^{25-26}$ |
|---|---|---|---|---|---|
| No. | $R^{1-5}$, $R^{11-15}$ | $R^{21-22}$ | $R^{23-24}$ | $R^{6-10}$, $R^{16-20}$ | (Vinylene group) |
| 1-1 | | | | $R^8$: Me, $R^{18}$: Me | $R^{25}$: 4, $R^{26}$: 4 |
| 1-2 | $R^3$: Me, $R^{13}$: Me | | | | $R^{25}$: 4, $R^{26}$: 4 |
| 1-3 | $R^4$: Me, $R^{12}$: Me | | | $R^8$: Me, $R^{18}$: Me | $R^{25}$: 4, $R^{26}$: 4 |
| 1-4 | $R^3$: Me, $R^{13}$: Me | $R^{22}$: 5-Me | | $R^8$: Me, $R^{18}$: Me | $R^{25}$: 4, $R^{26}$: 4 |
| 1-5 | $R^3$: Me, $R^{13}$: Me | $R^{22}$: 5-Me | | $R^9$: Me, $R^{17}$: Me | $R^{25}$: 4, $R^{26}$: 4 |
| 1-6 | $R^3$: Me, $R^{12}$: Me | $R^{21}$: 3-Me | | $R^8$: Me, $R^{18}$: Me | $R^{25}$: 4, $R^{26}$: 4 |
| 1-7 | $R^3$: Me, $R^{12}$: Me | $R^{21}$: 3-Me | | $R^9$: Me, $R^{17}$: Me | $R^{25}$: 4, $R^{26}$: 4 |
| 1-8 | $R^3$: Me, $R^{12}$: Me | $R^{21}$: 3-Me | $R^{24}$: 3-Me | $R^8$: Me, $R^{18}$: Me | $R^{25}$: 4, $R^{26}$: 4 |
| 1-9 | | | | $R^7$: Me, $R^8$: Me<br>$R^{17}$: Me, $R^{18}$: Me | $R^{25}$: 4, $R^{26}$: 4 |
| 1-10 | $R^4$: Me, $R^{12}$: Me | | | $R^7$: Me, $R^8$: Me<br>$R^{17}$: Me, $R^{18}$: Me | $R^{25}$: 4, $R^{26}$: 4 |

TABLE 1-continued

| Compound | Right side of molecule | | Left side of molecule | | $R^{25-26}$ |
|---|---|---|---|---|---|
| No. | $R^{1-5}$, $R^{11-15}$ | $R^{21-22}$ | $R^{23-24}$ | $R^{6-10}$, $R^{16-20}$ | (Vinylene group) |
| 1-11 | $R^3$: Me, $R^{13}$: Me | $R^{22}$: 3-Me | | $R^7$: Me, $R^8$: Me<br>$R^{17}$: Me, $R^{18}$: Me | $R^{25}$: 4, $R^{26}$: 4 |
| 1-12 | $R^3$: Me, $R^{12}$: Me | $R^{22}$: 3-Me | | $R^7$: Me, $R^8$: Me<br>$R^{17}$: Me, $R^{18}$: Me | $R^{25}$: 4, $R^{26}$: 4 |
| 1-13 | $R^3$: Me, $R^{12}$: Me | $R^{21}$: 3-Me | $R^{24}$: 3-Me | $R^7$: Me, $R^8$: Me<br>$R^{17}$: Me, $R^{18}$: Me | $R^{25}$: 4, $R^{26}$: 4 |
| 1-14 | | | | $R^8$: Et, $R^{18}$: Et | $R^{25}$: 4, $R^{26}$: 4 |
| 1-15 | | | | $R^8$: Et, $R^{17}$: Et | $R^{25}$: 4, $R^{26}$: 4 |
| 1-16 | $R^4$: Me, $R^{12}$: Me | | | $R^8$: Et, $R^{18}$: Et | $R^{25}$: 4, $R^{26}$: 4 |
| 1-17 | $R^3$: Me, $R^{13}$: Me | | | $R^8$: Et, $R^{18}$: Et | $R^{25}$: 4, $R^{26}$: 4 |
| 1-18 | $R^2$: Me, $R^4$: Me<br>$R^{12}$: Me, $R^{14}$: Me | | | $R^7$: Me, $R^8$: Me<br>$R^{17}$: Me, $R^{18}$: Me | $R^{25}$: 4, $R^{26}$: 4 |
| 1-19 | | | | | $R^{25}$: 4, $R^{26}$: 3 |
| 1-20 | | | | | $R^{25}$: 4, $R^{26}$: 2 |
| 1-21 | | | | | $R^{25}$: 4, $R^{26}$: 2 |
| 1-22 | $R^1$: Et, $R^5$: Me | | | | $R^{25}$: 4, $R^{26}$: 3 |
| 1-23 | $R^1$: Et, $R^5$: Me | | | $R^8$: Me, $R^{18}$: Me | $R^{25}$: 4, $R^{26}$: 4 |
| 1-24 | $R^1$: Et, $R^5$: Me | | | $R^9$: Me, $R^{17}$: Me | $R^{25}$: 4, $R^{26}$: 4 |
| 1-25 | $R^1$: Et, $R^5$: Me | | | $R^{16}$: Me, $R^{20}$: Et | $R^{25}$: 4, $R^{26}$: 4 |
| 1-26 | $R^1$: Me, $R^{11}$: Me | | | | $R^{25}$: 4, $R^{26}$: 4 |
| 1-27 | $R^1$: i-Pr | | | $R^{18}$: i-Pr | $R^{35}$: 4, $R^{26}$: 4 |
| 1-28 | $R^1$: Me | | | $R^{18}$: Me | $R^{25}$: 4, $R^{26}$: 4 |
| 1-29 | $R^1$: Et, $R^5$: Me | | | | $R^{25}$: 4, $R^{26}$: 4 |
| 1-30 | $R^1$: Et, $R^5$: Me | | | $R^9$: Me, $R^{19}$: Me | $R^{25}$: 4, $R^{26}$: 4 |
| 34 | | | | | $R^{25}$: 4, $R^{26}$: 4 |
| 35 | $R^3$: Me, $R^{13}$: Me | | | $R^8$: Me, $R^{18}$: Me | $R^{25}$: 4, $R^{26}$: 4 |
| 36 | $R^3$: Et, $R^{12}$: Me | | | $R^8$: Et, $R^{17}$: Me | $R^{25}$: 4, $R^{26}$: 4 |

The stilbene derivative (1) or (2) includes a cis-isomer represented by the following general formula (10) and a trans-isomer represented by the following general formula (11) depending on a difference in configuration between a central benzene ring to a vinylene group and triphenylamine as a peripheral substituent. The present invention includes each isomer and a mixture thereof.

(10)

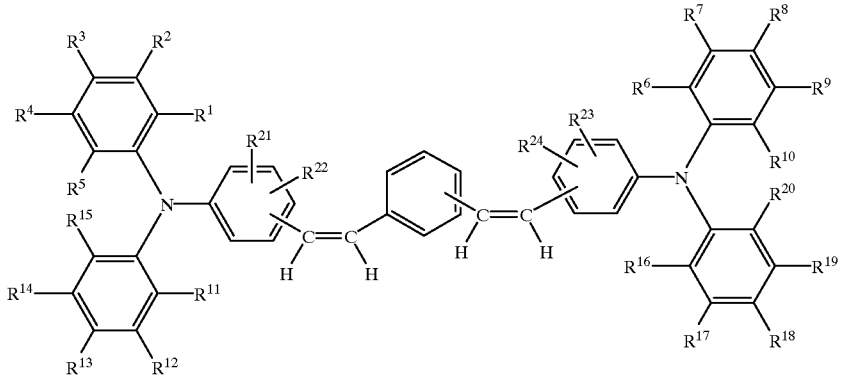

-continued (11)

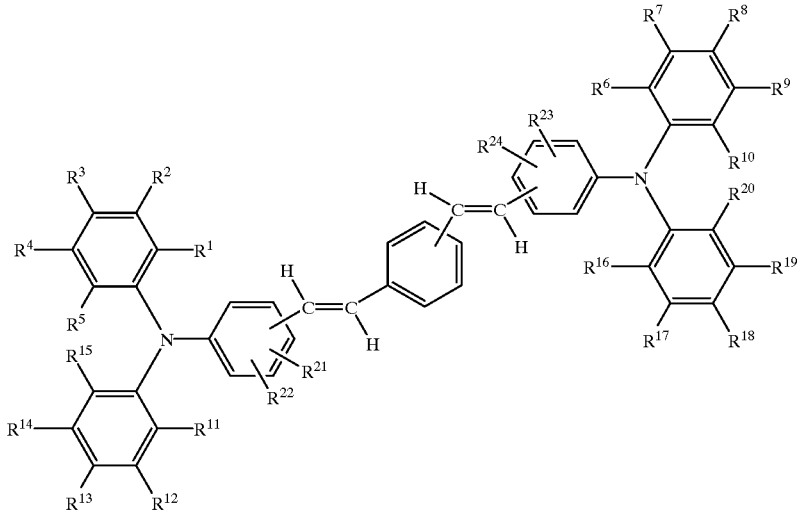

In the formulas (10) and (11), $R^1$ to $R^{24}$ are as defined in the general formula (1) or (2).)

Furthermore, the present invention includes an isomer which has a trans-form or a cis-form regarding two vinylene groups in one molecule, which is contaminated by a slight amount in the stilbene derivative (1) or (2).

In the electrophotosensitive material of the present invention, those containing the trans-isomer (11) in a large proportion are preferably used, that is, a ratio of the trans-isomer to the cis-isomer is one or more.

The stilbene derivative represented by the general formula (1) or (2) is suited for use as the hole transferring material in the electrophotosensitive material and can be used in various fields of solar battery and electroluminescence element because of its large charge mobility, that is, high hole transferability.

The stilbene derivative of the present invention can be produced by the production methods (A) and (B). The production method will be described in detail by way of the stilbene derivative represented by the general formula (1).

<<Production method (A)>>

Scheme (I)

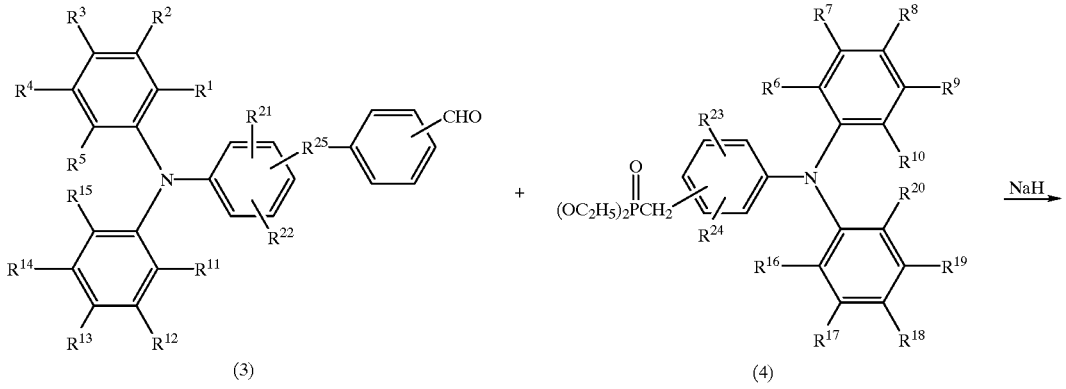

(3) (4)

-continued

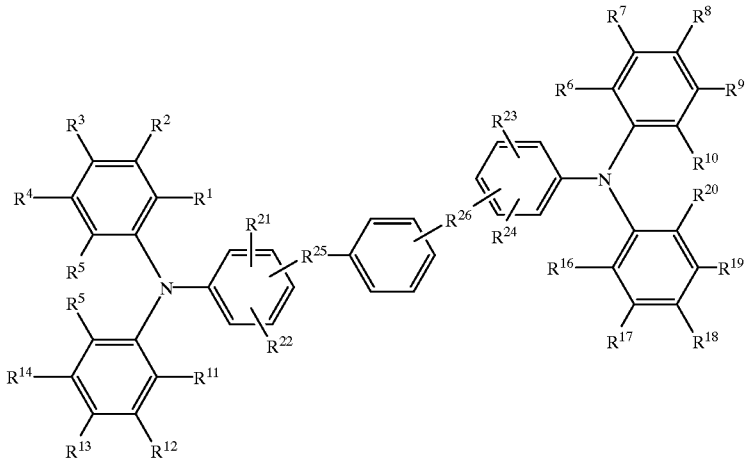

(1)

wherein $R^1$ to $R^{26}$ are defined above

According to this reaction, a stilbene derivative represented by the general formula (1) is obtained by 6 reacting an aldehyde derivative represented by the general formula (3) with a triphenylamine phosphate derivative represented by general formula (4) in a proper anhydrous solvent in the presence of a base.

The anhydrous solvent used in the reaction may be anyone as far as it does not exert any influence on the reaction. Examples thereof include ethers such as diethyl ether, tetrahydrofuran and dioxane; hydrogenated hydrocarbon such as methylene chloride, chloroform and dichloroethane; and aromatic hydrocarbons such as benzene and toluene.

Examples of the base include sodium hydride shown in the scheme (1) and metal hydride, for example, sodium alkoxide such as sodium methoxide.

The amount of the base is at least 1 to 2 moles, and preferably from 1 to 1.3 moles per mole of the triphenylamine phosphate (4).

The amount of the aldehyde derivative (3) is from 0.90 to 1.25 moles, and preferably from0.98 to 2.05 moles per mole of the triphenylamine phosphate derivative (4). The reaction is usually carried out at −10 to 25° C. and completed for about 3 to 12 hours.

Furthermore, the stilbene derivative represented by the general formula (2) is also obtained in the same manner as that described above.

Scheme (II)

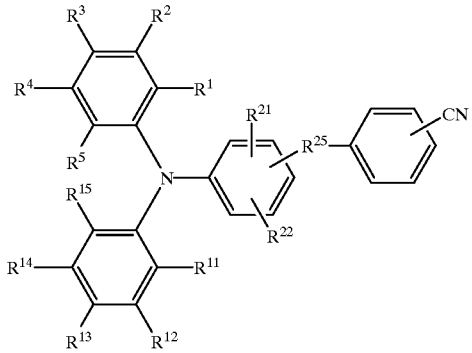

(12)

-continued

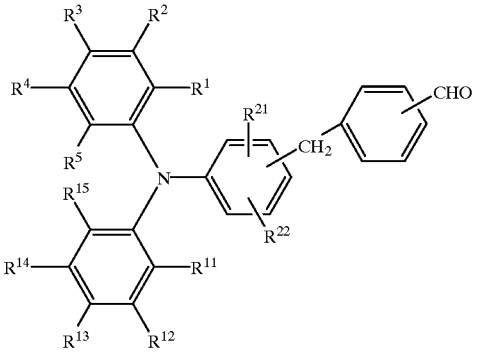

(3)

wherein $R^1$ to $R^5$, $R^{11}$ to $R^{15}$, $R^{21}$, $R^{22}$ and $R^{25}$ are as defined above According to this reaction, an aldehyde derivative (3) as a starting material of the scheme (I) is obtained by adding a cyano compound (12) and diisobutyl aluminum hydride (DIBAL) to a proper anhydrous solvent, respectively, mixing and reacting the solutions. The anhydrous solvent used in this reaction is the same as that used in the scheme (I).

The amount of the diisobutyl aluminum hydride (DIBAL) is at least 1 to 2 moles, and preferably from 1 to 1.3 moles per mole of the cyano compound (12).

The reaction is usually carried out at −10 to 25° C. and completed for about 3 to 12 hours.

Scheme (III)

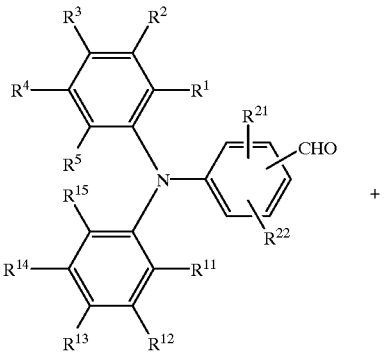

(13)

-continued

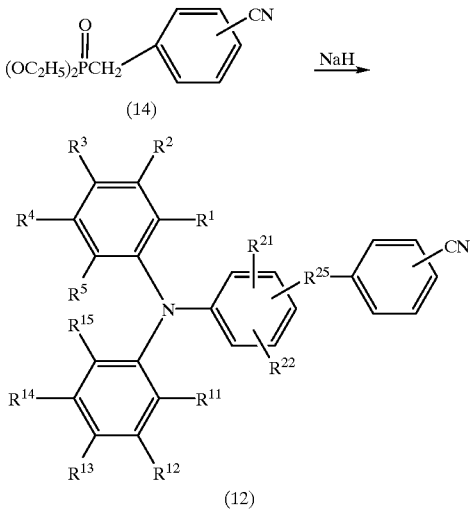

wherein $R^1$ to $R^5$, $R^{11}$ to $R^{15}$, $R^{21}$, $R^{22}$ and $R^{25}$ are as defined above.

According to this reaction, a cyano compound (12) as a starting material of the scheme (II) is obtained by reacting a folmylated triphenylamine derivative (13) with a cyanobenzyl phosphate derivative (14) in a proper anhydrous solvent in the presence of a base.

The anhydrous solvent and base used in this reaction include sodium hydride represented by the scheme (III) and metal hydride, for example, sodium alkoxide such as sodium methoxide.

The amount of the base is at least 1 to 2 moles, and preferably from 1 to 1.3 moles per mole of the cyanobenzyl phosphate derivative (14). The amount of the folmylated triphenylamine derivative (13) is from 0.90 to 1.25 moles, and preferably from 0.98 to 2.05 moles per mole of the cyanobenzyl phasphate (14). The reaction is usually carried out at −10 to 25° C. and completed for about 3 to 12 hours.

Scheme (IV)

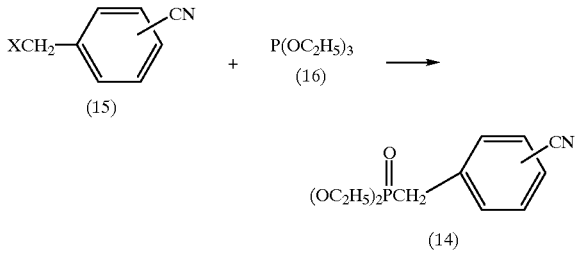

wherein X represents a halogen atom

According to this reaction, a cyanobenzyl phosphate (14) as a starting material of the scheme (III) is obtained by reacting a cyanobenzyl halide derivative (15) with triester phosphite (16) in the presence or absence of a proper solvent. In case where a tertiary amine is added, an alkyl halide is removed from the reaction system, thereby to accelerate the reaction.

The solvent used in the reaction may be anyone as far as it dose not exert any influence on the reaction. Examples thereof include ethers such as diethyl ether, tetrahydrofuran and dioxane; hydrogenated hydrocarbon such as methylene chloride, chloroform and dichloroethane; aromatic hydrocarbons such as benzene and toluene; and dimethylformamide.

Examples of the tertiary amine include triethylamine, tributylamine, pyridine and 4-(dimethylamino)pyridine.

The amount of the triester phosphite (16) is at least 1 mole, and preferably from 1 to 1.2 moles per mole of the cyanobenzyl halide derivative (15). The reaction is usually carried out at 80 to 150° C. and completed for about 1 to 4 hours.

Scheme (V)

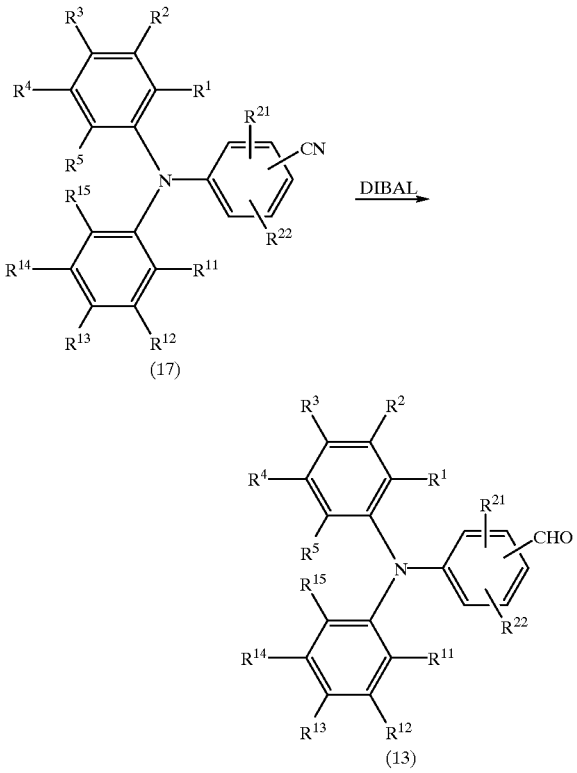

wherein $R^1$ to $R^5$, $R^{11}$ to $R^{15}$, $R^{21}$, $R^{22}$ and $R^{25}$ are as defined above.

According to this reaction, there is a formylated triphenylamine derivative (13) as a starting material of the scheme (III) by adding a cyanotriphenylamine derivative (17) and diisobutylaluminum halide (DIBAL) in a proper anhydrous solvent, respectively, and mixing and reacting the solutions. The anhydrous solvent used in the reaction is the same as that used in the scheme (I).

The amount of the diisobutylalminum halide (DIBAL) is from 1 to 2 moles, and preferably from 1 to 1.3 moles per mole of the cyanotriohenylamine derivative (17). The reaction is usually carried out at −10 to 25° C. and completed for about 3 to 12 hours.

In case of obtaining the formylated triphenylamine derivative (13-1) wherein $R^1$ is a group other than a hydrogen and $R^2$ to $R^{10}$, $R^{21}$ and $R^{22}$ are hydrogen atoms, formylation is conducted efficiently by using a Vilsmeier's method represented by the scheme (VI).

Scheme (VI)

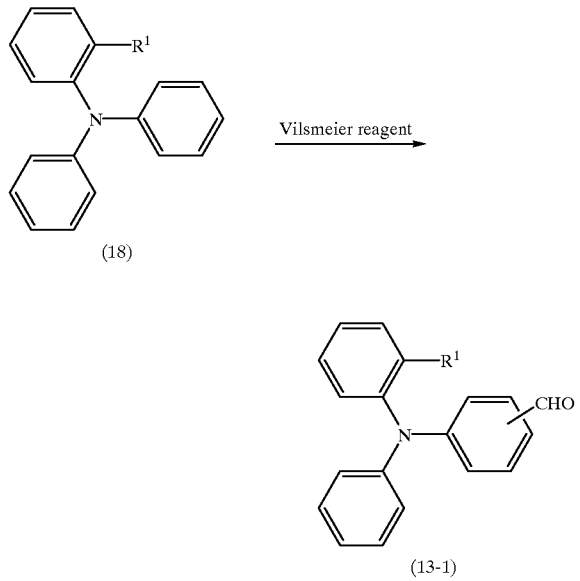

wherein $R^1$ is as defined above.

The reagent used in this reaction (Vilsmeier reagent) is prepared from a combination of (i) halogenating agents such as phosphorous oxychloride, phosgene, oxalyl chloride, thionyl chloride, triphenylphosphine bromine and hexachlorotriphosphazatrien; and (ii) N,N-dimethylformamide (DMF), N-methylformanilide (MFA) N-formylmorpholine and N,N-diisopropylformamide. In the present invention, a combination of phosphorous oxychloride and DMF that can also be used as the solvent is preferably used.

In the preparation of the Vilsmeier reagent, the molar ratio of the component (i) to the component (ii) is usually from 1:1-2, and preferably from 1:1 to 1:1.2.

The amount of the Vilsmeier reagent is from 0.9 to 2 times, and preferably from 1 to 1.1 moles per mole of the triphenylamine derivative (18). The formylation of the triphenylamine derivative (18) is usually carried out at 40 to 120° C. and completed for about 2 to 5 hours.

Scheme (VII)

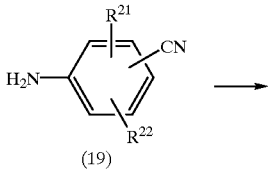

-continued

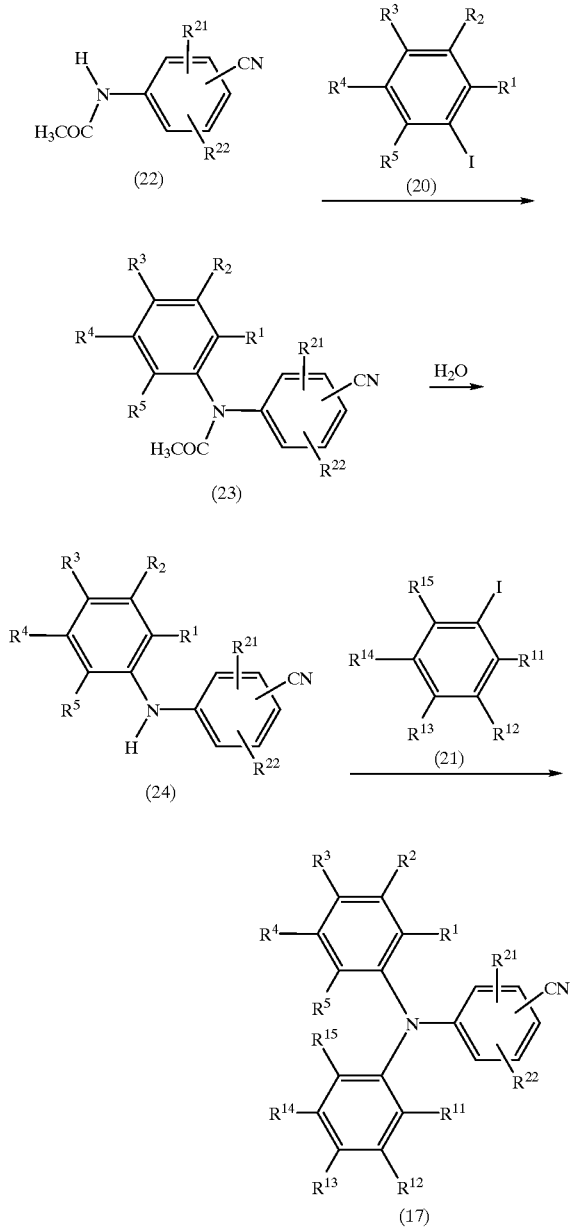

wherein $R^1$ to $R^5$, $R^{11}$ to $R^{15}$, $R^{21}$ and $R^{22}$ are as defined above According to this reaction, a cyanotriphenylamine derivative (17) as a starting material of the scheme (V) is obtained by reacting an aniline derivative (19) in turn with 2 types of iodobenzene derivatives (20) and (21). In the scheme (VII), first, the acetylaniline derivative (22) obtained by acetylating the aniline derivative (19) and another iodobenzene derivative (20) are added in nitrobenzene, and then the mixture is reacted in the presence of a catalyst such as anhydrous potassium carbonate and copper to obtain the acetylated diphenylamine derivative (23). Then, the acetylated diphenylamine derivative (23) is hydrolyzed to obtain a diphenylamine derivative (24). Finally, the diphenylamine derivative (24) and another iodobenzene derivative (21) are added in nitrobenzene and the mixture is reacted in the presence of a catalyst such as anhydrous potassium carbonate and copper to obtain a cyanotriphenylamine derivative (17).

Furthermore, in case of synthesizing those wherein arbitrary two or three benzene rings have the same substituent and substitution position among the cyanotriphenylamine derivative (17), they are preferably synthesized using a simple process by adding the aniline derivative (19) and iodobenzene derivative (20) in nitrobenzene and reacting the mixture in the presence of a catalyst such as anhydrous potassium carbonate and copper.

Scheme (VIII)

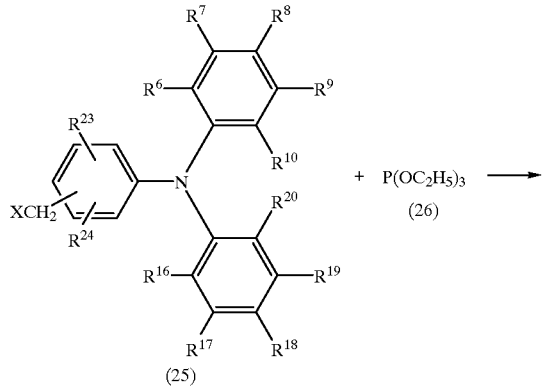

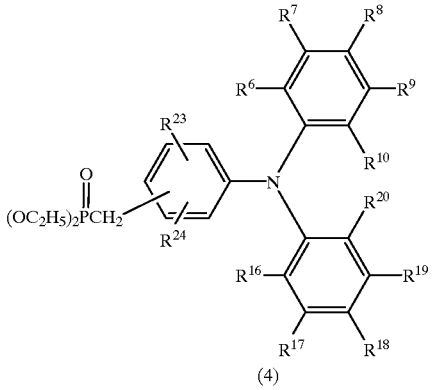

wherein $R^6$ to $R^{10}$, $R^{16}$ to $R^{20}$, $R^{23}$ and $R^{24}$ are as defined above, and X represents a halogen atom According to this reaction, a triphenylamine phosphate (4) as a starting material of the scheme (I) is obtained by reacting the halogenated methyltriphenylamine derivative (25) with triester phosphite (26) in the presence or absence of a proper solvent. In case where a tertiary amine is added, an alkyl halide is removed from the reaction system, thereby accelerating the reaction. The solvent and the tertiary amine used in the reaction are the same as those used in the scheme (IV).

The amount of the triester phosphite (26) is at least 1 mole, and preferably from 1 to 1.2 moles per mole of the halogenated methyltriphenylamine derivative (25). The reaction is usually carried out at 80 to 150° C. and completed for about 1 to 4 hours.

Scheme (IX)

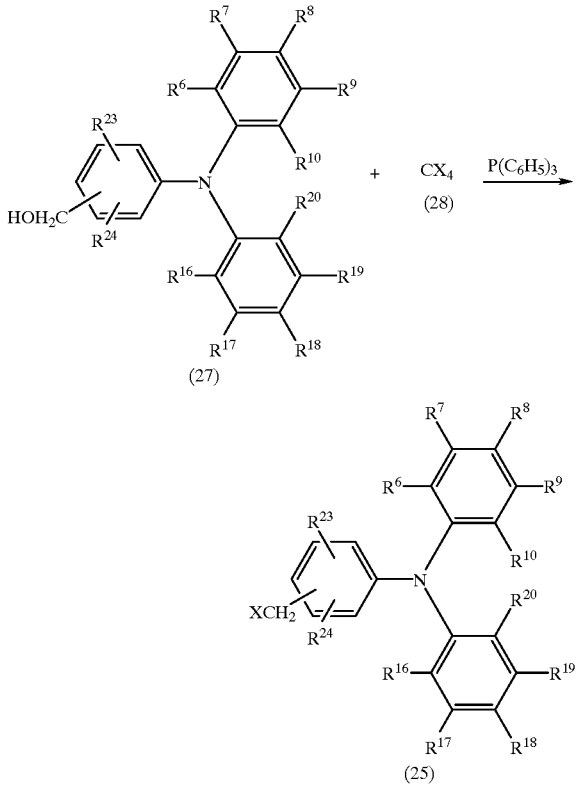

wherein $R^6$ to $R^{10}$ $R^{16}$ to $R^{20}$, $R^{23}$ and $R^{24}$ are as defined above, and X represents a halogen atom According to this reaction, a halogenated methyltriphenylamine derivative (25) as a starting material of the scheme (VIII) is obtained by reacting a triphenylamine methanol derivative (27) with a halogen compound (28) in a proper solvent in the presence of a catalyst.

Examples of the halogen compound include carbon tetrachloride, carbon tetrabromide, carbon tetraiodide and concentrated hydrochloric acid.

The solvent includes ethers such as diethyl ether, tetrahydrofuran and dioxane; halogenated hydrocarbons such as methylene chloride, chloroform and dichloroethane; and aromatic hydrocarbons such as benzene and toluene.

As the catalyst, triphenylphosphine is preferably used.

The amount of the halogen compound (28) is from 0.90 to 1.25 moles, and preferably from 0.98 to 2.05 moles per mole of the triphenylamine methanol derivative (27). On the other hand, the amount of the catalyst is at least 1 mole, and preferably from 0.98 to 2.05 moles per mole of the triphenylmine methanol derivative (27). The reaction is usually carried out at −10 to 25° C. and completed for about 1 to 10 hours.

Scheme (X)

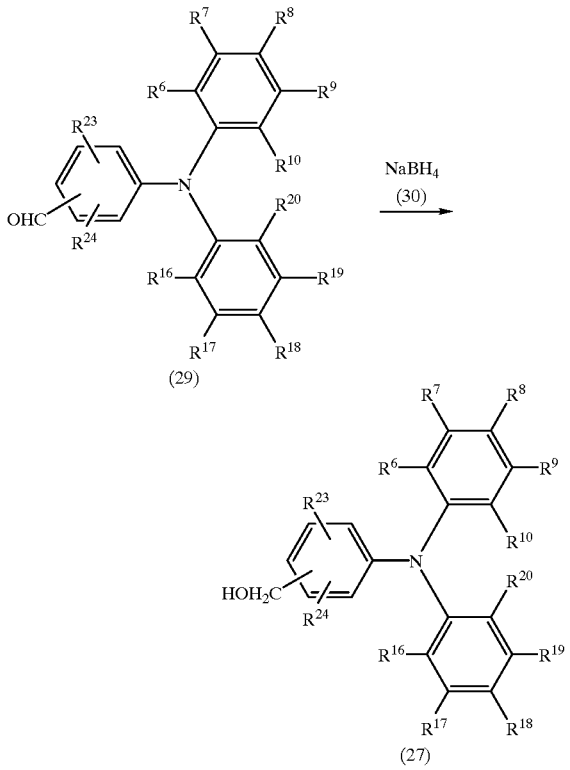

wherein $R^6$ to $R^{10}$, $R^{16}$ to $R^{20}$, $R^{23}$ and $R^{24}$ are as defined above According to this reaction, a triphenylamine methanol derivative (27) as a starting material of the scheme (IX) is obtained by reacting a formylated triphenylamine derivative (29) with sodium borohydride (30) in methanol.

The amount of the sodium borohydride (30)is at least 1 mole, and preferably from 1 to 1.3 moles per mole of the formylated triphenylamine derivative (29). The reaction is usually carried out at −10 to 25° C. and completed for about 3 to 12 hours.

The formylated triphenylamine derivative (29) as the starting material of the scheme (X) is obtained by replacing the substituents $R^1$ to $R^5$ by $R^6$ to $R^{10}$, $R^{11}$ to $R^{15}$ y $R^{16}$ to $R^{20}$, $R^{21}$ to $R^{22}$ by $R^{23}$ to $R^{24}$, and $R^{25}$ by $R^{26}$, respectively, in the scheme (V) or (VI).

<<Production method (B)>>

Scheme (XI)

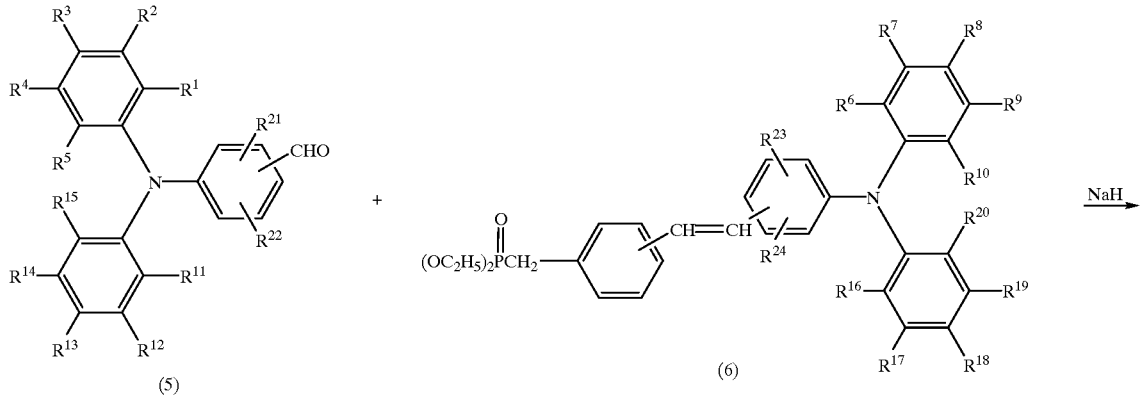

-continued

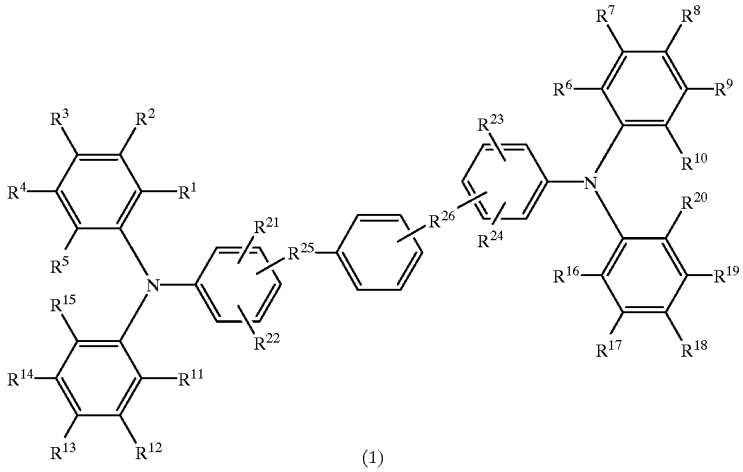

(1)

wherein $R^1$ to $R^{26}$ are as defined above

According to this reaction, a stilbene derivative represented by the general formula (1) is obtained by reacting a formylated triphenylamine derivative represented by the general formula (5) with a monostilbene derivative represented by the general formula (6) in a proper solvent in the presence of a base. The anhydrous solvent and base used in the reaction are the same as those used in the scheme (I). The amount of the base is at least 1 to 2 moles, and preferably from 1 to 1.3 moles per mole of the formylated triphenylamine derivative (5).

The amount of the monostilbene derivative (6) is from 0.90 to 1.25 moles, and preferably from 0.98 to 2.05 moles per mole of the formylated triphenylamine derivative (5). The reaction is usually carried out at −10 to 25° C. and completed for about 3 to 12 hours.

Scheme (XII)

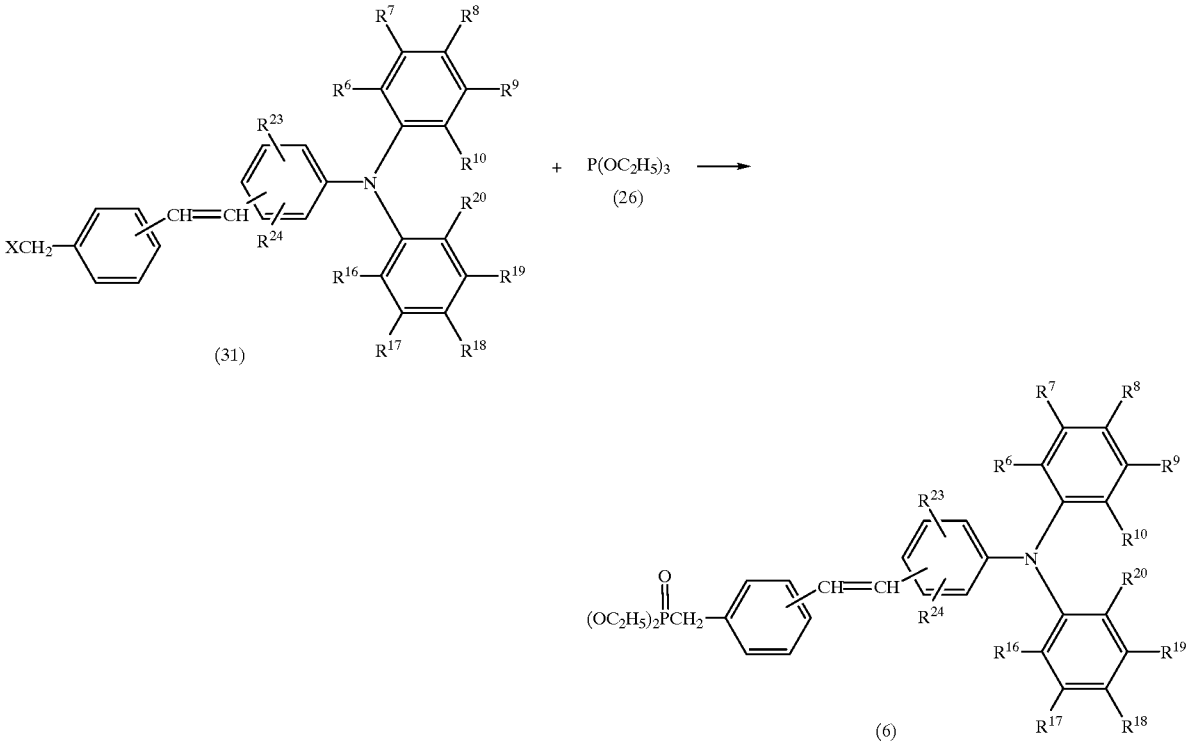

wherein $R^6$ to $R^{10}$, $R^{16}$ to $R^{20}$, $R^{23}$ and $R^{24}$ are as defined above, and X represents a halogen atom According to this reaction, a monostilbene derivative (6) as a starting material of the scheme (XI) is obtained by reacting a halogenated carbon-substituted monostilbene derivative (31) with triester phosphite (26) in the presence or absence of a proper solvent. In case where a tertiary amine is added, an alkyl halide is removed from the reaction system, thereby accelerating the reaction.

The solvent and the tertiary amine used in the reaction are the same as those used in the scheme (IV).

The amount of the triester phosphite (26) is at least 1 moles, and preferably from 1 to 1.2 moles per mole of the halogenated carbon-substituted monostilbene derivative (31). The reaction is usually carried out at 80 to 150° C. and completed for about 1 to 4 hours.

Scheme (XIII)

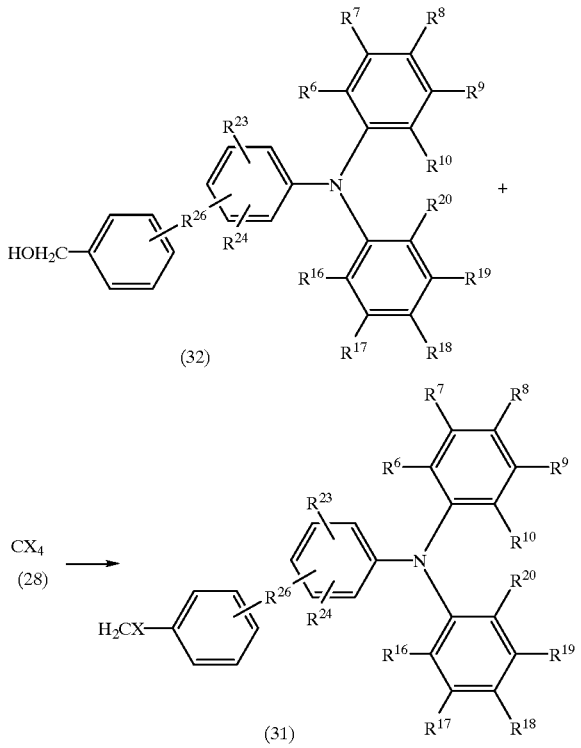

wherein $R^6$ to $R^{10}$, $R^{16}$ to $R^{20}$, $R^{23}$ and $R^{24}$ are as defined above, and X represents a halogen atom According to this reaction, a hydrogenated carbon-substituted monostilbene derivative (31) as a starting raw material of the scheme (XII) is obtained by reacting a hydroxymethylated triphenylamine derivative (32) with a halogen compound (28) in a proper solvent in the presence of a catalyst.

The carbon halide, solvent and catalyst used in the reaction are the same as those used in the scheme (IX).

The amount of the halide (28) is 0.90 to 1.25 moles, and preferably from 0.98 to 2.05 moles per mole of the hydroxymethylated triphenylamine derivative (32). On the other hand, the amount of the catalyst is at least 1 mole, and preferably from 0.98 to 2.05 moles per mole of the hydroxymethylated triphenylamine derivative (32). The reaction is usually carried out at −10 to 25° C. and completed for about 1 to 10 hours.

Scheme (XIV)

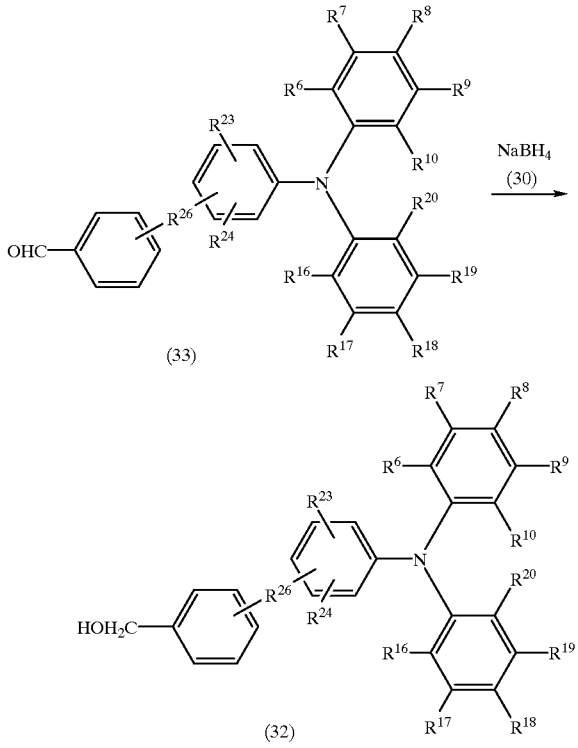

wherein $R^6$ to $R^{10}$, $R^{16}$ to $R^{20}$, $R^{23}$ and $R^{24}$ are as defined above According to this reaction, a hydroxymethylated triohenylamine derivative (32) as a starting raw material of the scheme (XIII) is obtained by reacting an aldehyde derivative (33) with sodium borohydride (30)in methanol.

The amount of the sodium borohydride (30) is at least 1 mole, and preferably from 1 to 1.3 moles per mole of the aldehyde derivative (33). The reaction is usually carried out at −10 to 25° C. and completed for about 3 to 12 hours.

The aldehyde derivative (33) as the starting raw material of the scheme (XIV) is obtained by replacing the substituents $R^1$ to $R^5$ by $R^6$ to $R^{10}$, $R^{11}$ to $R^{15}$ by $R^{16}$ to $R^{20}$, $R^{21}$, to $R^{22}$ by $R^{23}$ to $R^{24}$ and $R^{25}$ by $R^{26}$, respectively, in the schemes (II) to (VI).

The formylated triphenylamine derivative (5) as the starting material of the scheme (XI) is obtained by the scheme (V) or (VI).

The electrophotosensitive material of the present invention will be described in detail below.

The electrophotosensitive material of the present invention is produced by forming a single photosensitive layer on a conductive substrate, the photosensitive layer containing at least one stilbene derivative wherein molecular structures of triphenylamino groups located at both sides of a benzene ring in a molecular center are unsymmetric with respect to the benzene ring. The photosensitive material includes single-layer type and multi-layer type photosensitive materials, as described above, but the present invention can be applied to both of them.

The single-layer type photosensitive material is produced by forming a single photosensitive layer on a conductive substrate. This photosensitive layer is formed by dissolving or dispersing at least one stilbene derivative wherein molecular structures of triphenylamino groups located at both sides of a benzene ring in a molecular center are unsymmetric with respect to the benzene ring (hole transferring material), an electric charge generating material and a binder resin and, if necessary, an electron transferring material in a proper solvent, and coating the resulting coating solution on a conductive substrate, followed by drying. Such a single-layer type photosensitive material can be applied to any of positively and negatively charging type photosensitive materials with a single construction, and also has a simple layer construction and is superior in productivity.

Regarding the single-layer type electrophotosensitive material of the present invention, the residual potential of the photosensitive material is drastically lowered and the sensitivity and repeating stability are improved as compared with a conventional single-layer type electrophotosensitive material.

On the other hand, the multi-layer type photosensitive material is produced by forming an electric charge generating layer containing an electric charge generating material using a deposition or coating means, coating a coating solution containing at least one stilbene derivative wherein molecular structures of triphenylamino groups located at both sides of a benzene ring in a molecular center are unsymmetric (hole transferring material) and a binder resin, followed by drying to form an electric charge transferring layer. To the contrary, the electric charge transferring layer may be formed on the conductive substrate, followed by formation of the electric charge generating layer thereon. Since the electric charge generating layer has a very thin film thickness as compared with the electric charge transferring layer, it is preferred that the electric charge generating layer is formed on the conductive substrate and the electric charge transferring layer is formed to protect the electric charge generating layer.

The charging type (positively or negatively charging) of the multi-layer type photosensitive layer is selected depending on the formation order of the electric charge generating layer and electric charge transferring layer and the kinds of the electric charge transferring material used in the electric charge transferring layer. In case where the electric charge generating layer is formed on the conductive substrate and the electric charge transferring layer is formed thereon, when using the hole transferring material such as stilbene derivative of the present invention as the electric charge transferring material of the electric charge transferring layer, the photosensitive material becomes a negatively charging type.

Regarding the multi-layer type electrophotosensitive material of the present invention, the residual potential of the photosensitive material is drastically lowered and the sensitivity is improved as compared with an electrophotosensitive material using a conventional stilbene derivative as the hole transferring material.

As described above, the electrophotosensitive material of the present invention can be applied to any of single-layer and multi-layer types, however, a single-layer type electrophotosensitive material is preferred because it can attain applicability to any of positively and negatively charging types, easy production due to simple structure, inhibition of film defects on formation of layers, and improvement in optical characteristics due to less interface between layers.

Various materials used in the electrophotosensitive material of the present invention will be described below.

<<Electric charge generating material>>

The electric charge generating material used in the present invention include, for example, organic photoconductive materials such as phthalocyanine pigment, polycyclic quinone pigment, azo pigment, perylene pigment, indigo pigment, quinacridone pigment, azulenium salt pigment, squarilium pigment, cyanine pigment, pyrylium pigment, thiopyrylium pigment, xanthene pigment, quinoneimine pigment, triphenylmethane pigment, styryl pigment, anthanthrone pigment, pyrylium salt, triphenylmethane pigment, threne pigment, toluidine pigment and pyrrazoline pigment; and inorganic photoconductive materials such as selenium, tellurium, amorphous silicon and cadmium sulfide. These electric charge generating materials can be uses alone or in combination.

Among these electric charge generating materials, for example, phthalocyanine pigments such as metal-free phthalocyanine represented by the general formula (CG1)

(CG 1)

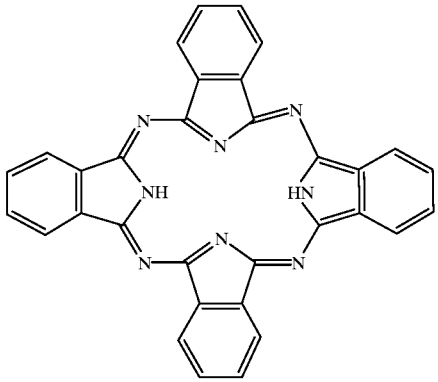

and oxotitanyl phthalocyanine represented by the general formula (CG2):

(CG 2)

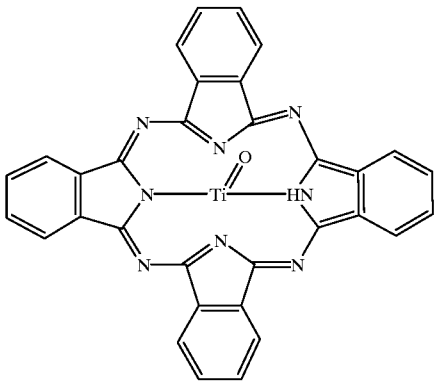

are preferably used because the photosensitive material having the sensitivity at the wavelength range of 700 nm or more is required in digital and optical image forming apparatus such as laser beam printer using a light source (e.g. semiconductor laser, etc.) and facsimile. The crystal form of the phthalocyanine pigment is not specifically limited and those having various crystal forms can be used.

Since the photosensitive material having the sensitivity within at the visible range is required in analogue and optical image forming apparatus such as electrostatic copying machine using a white light source (e.g. halogen lamp etc.), for example, a perylene or bisazo pigment represented by the general formula (CG3)

(CG 3)

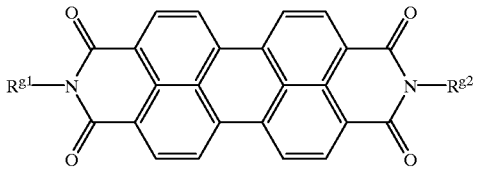

wherein $R^{g1}$ and $R^{g2}$ are the same or different and each represents a substituted or non-substituted alkyl group having 18 or less carbon atoms, a cycloalkyl group, an aryl group, an alkanoyl group, or an aralkyl group.

<<Hole transferring material>>

In the electrophotosensitive material of the present invention, other conventionally known holes transferring materials may be contained, together with at least one of the stilbene derivatives of the present invention as the hole transferring material.

The hole transferring material includes various compounds having high hole transferability, for example, nitrogen-containing compounds and condensed polycyclic compounds such as oxadiazole compound [e.g. 2,5-di(4-methylaminophenyl)-1,3,4-oxadiazole], styryl compound [e.g. 9-(4-diethylaminostyryl)anthracene], carbazole compound [e.g. poly-N-vinylcarbazole], organopolysilane compound, pyrazoline compound [e.g. 1-phenyl-3-(p-dimethylaminophenyl)pyrazoline], hydrazone compound, triphenylamine compound, indole compound, oxazole compound, isoxazole compound, thiazole compound, thiadiazole compound, imidazole compound, pyrazole compound, triazole compound and stilbene compound.

In the present invention, these hole transferring materials can be used alone or in combination. When using the hole transferring material having a film forming property such as polyvinylcarazole, a binder resin is not required necessarily.

<<Electron transferring material>>

The electron transferring material used in the present invention includes various compounds having high electron transferability, for example, pyrene compound, carbazole compound, hydrazone compound, N,N-dialkylaniline compound, diphenylamine compound, triphenylamine compound, triphenylamine compound, triphenylmethane compound, naphthoquinone compound, pyrazoline compound, benzoquinone compound, malononitrile, thiopyran compound, tetracyanoethylenecyanoethylene, 2,4,8-trinitrothioxanthone, dinitrobenzene, dinitroanthracene, dinitroacridine, nitroanthraquinone, succinic anhydride, maleic anhydride and dibromomaleic anhydride.

In the present invention, these electron transferring materials can be used alone or in combination.

<<Binder resin>>

The binder resin in which the above respective components are dispersed, there can be used various resins which have hitherto been used in the photosensitive layer. Examples thereof include thermoplastic resins such as various polycarbonates having a bisphenol A skeleton or a bisphenol Z skeleton, polyallylate, polyester, styrene-butadiene copolymer, styrene-acrylonitrile copolymer, styrene-maleic acid copolymer, acrylic copolymer, styrene-acrylic copolymer, polyethylene, ethylene-vinyl acetate copolymer, chlorinated polyethylene, polyvinyl chloride, polypropylene, ionomer, vinyl chloride-vinyl acetate copolymer, alkyd resin, polyamide, polyurethane, polysulfone, diallyl phthalate polymer, ketone resin, polyvinyl butyral and polyether; crosslinkable thermosetting resins such as silicone resin, epoxy resin, phenol resin, urea resin and melamine resin; and photocurable resins such as epoxy acrylate and urethane acrylate. These binder resins can be used alone or in combination.

In addition to the above respective components, conventionally known various additives such as oxidation inhibitors, radical scavengers, singlet quenchers, antioxidants (e.g. ultraviolet absorbers), softeners, plasticizers, surface modifiers, excipients, thickeners, dispersion stabilizers, waxes, acceptors and donors. To improve the sensitivity of the photosensitive layer, for example, known sensitizers such as terphenyl, halonaphthoquinones and acenaphthylene may be used in combination.

In the single-layer type photosensitive material, the electric charge generating material may be incorporated in the amount within a range from 0.1 to 50 parts by weight, and preferably from 0.5 to 30 parts by weight, based on 100 parts by weight of the binder resin. The stilbene derivative (1) (hole transferring material) of the present invention may be incorporated in the amount within a range from 20 to 500 parts by weight, and preferably from 30 to 200 parts by weight, based on 100 parts by weight of the binder resin. When the electron transferring material is contained, the electron transferring material may be incorporated in the amount within a range from 5 to 100 parts by weight, and preferably from 10 to 80 parts by weight, based on 100 parts by weight of the binder resin. The thickness of the single-layer type photosensitive layer is within a range from about 5 to 100 $\mu$m, and preferably from about 10 to 50 $\mu$m.

In the multi-layer type photosensitive material, the electric charge generating material and binder resin, which constitute the electric charge generating layer, can be incorporated in various ratios, but the electric charge generating material may be incorporated in the amount within a range from 5 to 1000 parts by weight, and preferably from 30 to 500 parts by weight, based on the weight of the binder resin. When the hole transferring material is contained in the electric charge generating layer, the hole transferring material may be incorporated in the amount within a range from 10 to 500 parts by weight, and preferably from 50 to 200 parts by weight, based on 100 parts by weight of the binder resin.

The hole transferring material and binder resin, which constitute the electric charge transferring layer, can be incorporated in various ratios as far as the transfer of the electric charges is not prevented and crystallization does not occur. The stilbene derivative (1) (hole transferring material) of the present invention is preferably incorporated in the amount within a range from 10 to 500 parts by weight, and particularly from 25 to 200 parts by weight, based on 100 parts by weight of the binder resin, so that the electric charges generated by light irradiation in the electric charge generating layer can be transferred easily. When the electron transferring material is contained in the electric charge generating layer, the electron transferring material may be incorporated in the amount within a range from 5 to 200 parts by weight, and preferably from 10 to 100 parts by weight, based on 100 parts by weight of the binder resin.

A barrier layer may be formed between the conductive substrate and photosensitive layer in the single-layer type photosensitive layer, whereas, the barrier layer may be formed between the conductive substrate and electric charge generating layer, or between the conductive substrate and electric charge transferring layer, or between the electric charge generating layer and electric charge transferring layer in the photosensitive layer having a single-layer type photosensitive layer, as far as characteristics of the photosensitive material are not prevented. A protective layer may be formed on the surface of the photosensitive material.

As the conductive substrate on which the photosensitive layer is formed, for example, various materials having the conductivity can be used. The substrate includes, for example, conductive substrates made of metals such as iron, aluminum, copper, tin, platinum, silver, vanadium, molybdenum, chromium, cadmium, titanium, nickel, palladium, indium, stainless steel and brass; substrates made of plastic materials prepared by depositing or laminating the above metals; and substrates made of glasses coated with aluminum iodide, tin oxide and indium oxide.

The conductive substrate may be in the form of a sheet or drum according to the structure of the image forming apparatus to be used. The substrate itself may have the conductivity, or the surface of the substrate may have the conductivity. The conductive substrate may be preferably those having a sufficient mechanical strength on use.

When the photosensitive layer is formed by the coating method, a dispersion is prepared by dispersing and mixing the above electric charge generating material, electric charge transferring material and binder resin, together with a proper solvent, using a known method such as roll mill, ball mill, attritor, paint shaker, and ultrasonic dispersing equipment to prepare a dispersion, and then the resulting dispersion is coated by using a known means and dried.

As the solvent for preparing the dispersion, various organic solvents can be used. Examples thereof include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, chloroform, carbon tetrachloride and chlorobenzene; ethers such as dimethyl ether, diethyl ether, tetrahydrofuran, ethylene glycol dimethyl ether and diethylene glycol dimethyl ether; ketones such as acetone, methyl ethyl ketone and cylohexanone; esters such as ethyl acetate and methyl acetate; and dimethylformaldehyde, dimethylformamide and dimethyl sulfoxide. These solvents can be used alone, or two or more kinds of them can be used in combination.

To improve the dispersion properties of the electric charge generating material and electric charge transferring material, and the smoothness of the surface of the photosensitive layer, for example, surfactants and leveling agents may be added.

EXAMPLES

The following Synthesis Examples, Examples and Comparative Examples further illustrate the present invention in detail.

<Synthesis of formylated triphenylamine derivative>

Reference Example A1

To 0.087 moles (24 g) of 2-ethyl-6-methyltriphenylamine, 50 ml of N,N-dimethylformamide (DMF) was added, followed by stirring. While cooling in an ice bath, 0.13 moles (20 g) of phosphorous oxychloride was gradually added dropwise and the mixture was stirred at 90 to 100° C. for two hours. After the completion of the reaction, the reaction solution was poured into iced water, followed by extraction with ethyl acetate. The extract was washed with water and dried over anhydrous sodium sulfate, and then the solvent was distilled off. The resulting product was purified by subjecting to column chromatography (developing solution: mixed solvent of chloroform and hexane) to obtain 16 g of 2-ethyl-6-methyl-4'-formyltriphenylamine (yield: 61%).

Reference Example A2

In the same manner as in Reference Example A1 except for using 0.087 moles (20 g) of triphenylamine in place of 2-ethyl-6-methyltriphenylamine, 12 g of 4-formyltriphenylamine was obtained (yield: 61%).

Reference Example A3

In the same manner as in Reference Example A1 except for using 0.087 moles (20 g) of 4,4'-dimethyltriphenylamine in place of 2-ethyl-6-methyltriphenylamine, 15 g of 4,4'-dimethyl-4"-formyltriphenylamine was obtained (yield: 57%).

Reference Example A4

In the same manner as in Reference Example A1 except for using 0.087 moles (20 g) of 3,3'-dimethyltriphenylamine in place of 2-ethyl-6-methyltriphenylamine, 15 g of 3,3'-dimethyl-4"-formyltriphenylamine was obtained (yield: 57%).

Reference Example A5

0.037 moles (10 g) of 3-cyanotriphenylamine and 40 ml of diisobutylaluminum hydride (DIBAL) were added respectively to 100 ml of tetrahydrofuran (THF), and then the respective solutions thus obtained were mixed and stirred at 20° C. for three hours. After the completion of the reaction, the reaction solution was poured into iced water, followed by extraction with ethyl acetate. The extract was washed with water and dried over anhydrous sodium sulfate, and then the solvent was distilled off. The resulting product was purified by subjecting to column chromatography (developing solution: mixed solvent of chloroform and hexane) to obtain 9 g of 3-formyltriphenylamine (yield: 89%).

<<Synthesis of aldehyde derivative>>

Reference Example B1

0.016 moles (4.0 g) of diethyl 4-cyanobenzylphosphate (14) was deaerated and replaced by argon and tetrahydrofuran (THF) was added. After cooling in an ice bath, 0.016 moles (0.39 g) of sodium hydride was added dropwise, followed by stirring for two hours while maintaining the temperature. 0.016 moles (5.0 g) of 2-ethyl-6-methyl-4'-formyltriphenylamine in THF was added dropwise at the same temperature, followed by stirring at 0° C. to room temperature for 24 hours. After the completion of the reaction, water was added and the reaction solution was extracted with ethyl acetate. The extract was washed with water and dried over sodium sulfate, and then the solvent was distilled off to obtain 5 g of unpurified 2-ethyl-6-methyl-4'-(4-cyanostyryl)-triphenylamine.

In an argon atmosphere, 60 ml of THF was added to 5 g of 2-ethyl-6-methyl-4'-(4-cyanostyryl)-triphenylamine thus obtained, followed by cooling in an ice bath. To the mixture, 0.013 moles (9 ml) of dibutylaluminum hydride (DIBAL) was gradually added dropwise. After the completion of the reaction, the reaction solution was poured into icedwater, followed by extraction with ethyl acetate. The extract was washed with water and dried over anhydrous sodium sulfate, and then the solvent was distilled off. The resulting product was purified by subjecting to column chromatography (developing solution: mixed solvent of chloroform and hexane) to obtain 4.6 g of 2-ethyl-6-methyl-4'-(4-formylstyryl)-triphenylamine (yield: 85%).

Reference Example B2

In the same manner as in Reference Example B1 except for using 0.087 moles (20 g) of 4-formyltriphenylamine in place of 2-ethyl-6-methyl-4'-formyltriphenylamine, 4.2 g of 4-(4-formylstyryl)-triphenylaminewas obtained (yield: 83%).

Reference Example B3

In the same manner as in Reference Example B1 except for using 0.016 moles (4.8 g) of 4,4'-dimethyl-4"-formyltriphenylamine in place of 2-ethyl-6-methyl-4'-formyltriphenylamine, 4,4'-dimethyl-4"-(4-formylstyryl)-triphenylamine was obtained (yield: 86%).

<<Synthesis of triphenylaminephosphate>>

Reference Example C1

To 0.032 moles (7.9 g) of 4-formyltriphenylamine, 150 ml of methanol was added, followed by stirring. Then, 0.032 moles (1.2 g) was added while cooling in an ice bath. After this mixed solution was stirred at room temperature for 24 hours, water was added to terminate the reaction and the solvent was distilled off. The resulting product was extracted with chloroform, washed with water and dried over anhydrous sodium sulfate, and then the solvent was distilled off to obtain 8.7 g of unpurified 4-hydroxymethyltriphenylamine.

To 8.7 g of 4-hydroxymethyltriphenylamine thus obtained, 100 ml of dichloromethane was added and 0.035 moles (3.65 g) of concentrated hydrochloric acid was gradually added dropwise while cooling in an ice bath. After the completion of the reaction, the organic layer was dried over anhydrous sodium sulfate and dried, and then the solvent was distilled off to obtain 8 g of unpurified 4-chloromethyltriphenylamine.

To 8 g of 4-chloromethyltriphenylamine thus obtained, 0.028 moles (4.7 g) of triethyl phosphite was added, followed by stirring at 150 to 160° C. for five hours. After the completion of the reaction, the reaction solution was poured into iced water, followed by extraction with ethyl acetate. The extract was washed with water and dried over anhydrous sodium sulfate, and then the solvent was distilled off. The resulting product was purified by subjecting to column chromatography (developing solution: mixed solvent of chloroform and hexane) to obtain 6.8 g of 4-diethyltriphenylamine phosphate (yield: 63%).

Reference Example C2

In the same manner as in Reference Example C1 except for using 0.032 moles (8.7 g) of 4,4'-dimethyl-4"-formyltriphenylamine in place of 4-formyltriphenylamine, 7.4 g of 4,4'-dimethyl-4"-diethyltriphenylamine phosphate was obtained (yield: 64%).

Reference Example C3

In the same manner as in Reference Example C1 except for using 0.032 moles (8.7 g) of 3,3'-dimethyl-4"-formyltriphenylamine in place of 4-formyltriphenylamine, 7.1 g of 3,3'-dimethyl-4"-diethyltriphenylamine phosphate was obtained (yield: 61%).

Reference Example C4

In the same manner as in Reference Example C1 except for using 0.032 moles (7.9 g) of 5-formyltriphenylamine in place of 4-formyltriphenylamine, 6.8 g of 5-diethyltriphenylamine phosphate was obtained (yield: 63%).

<<Synthesis of stilbene derivative>>

Synthesis Example 1

0.011 moles (4.3 g) of 4-diethyltriphenylamine phosphate was charged in a flask, deaerated and then displaced by argon. 150 ml of anhydrous THF was added and 0.011 moles (0.27 g) of sodium hydride was gradually added dropwise, followed by stirring for two hours while maintaining at 0° C. 0.011 moles (4.4 g) of 2-ethyl-6-methyl-4'-(4-formylstyryl)-triphenylamine in THF was added dropwise at the same temperature, followed by stirring at 0° C. to room temperature for three hours. After the completion of the reaction, water was added to terminate the reaction. The reaction solution was extracted with ethyl acetate and was washed with water, and then the solvent was distilled off. The resulting product was purified by subjecting to column chromatography (developing solution: mixed solvent of chloroform and hexane) to obtain 4.4 g of a stilbene derivative corresponding to the compound No. (1-29) in Table 1 (yield: 62%, melting point: 89° C.).

Synthesis Example 2

In the same manner as in Synthesis Example 1 except for using 0.011 moles (4.7 g) of 4,4'-dimethyl-4"-diethyltriphenylamine phosphate in place of 4-diethyltriphenylamine phosphate, 5.2 g of a stilbene derivative corresponding to the compound No. (1-23)in Table 1 was obtained (yield: 69%, melting point: (101° C.)

Synthesis Example 3

In the same manner as in Synthesis Example 1 except for using 0.011 moles (4.7 g) of 3,3'-dimethyl-4"-diethyltriphenylamine phosphate in place of 4-diethyltriphenylamine phosphate, 4.9 g of a stilbene derivative corresponding to the compound No. (1-30) in Table 1 was obtained (yield: 65%, melting point:

Synthesis Example 4

In the same manner as in Synthesis Example 1 except for using 0.011 moles (4.3 g) of 5-diethyltriphenylamine phosphate in place of 4-diethyltriphenylamine phosphate, 4.5 g of a stilbene derivative corresponding to the compound No. (1-22) in Table 1 was obtained (yield: 63%, melting point: 87° C.).

Synthesis Example 5

In the same manner as in Synthesis Example 1 except for using 0.011 moles (4.4 g) of 4,4'-dimethyl-4"-(4-formylstyryl)-triphenylamine in place of 2-ethyl-6-methyl-4'-(4-formylstyryl)-triphenylamine phosphate, 4.1 g of a stilbene derivative corresponding to the compound No. (1-2) in Table 1 was obtained (yield: 57%, melting point: 107° C.).

Synthesis Comparative Example 1

In the same manner as in Synthesis Example 1 except for using 0.011 moles (4.1 g) of 4-(4-formylstyryl)-triphenylamine in place of 2-ethyl-6-methyl-4'-(4-formylstyryl)-triphenylamine phosphate, 4.6 g of a stilbene derivative represented by the following general formula (34):

(34)

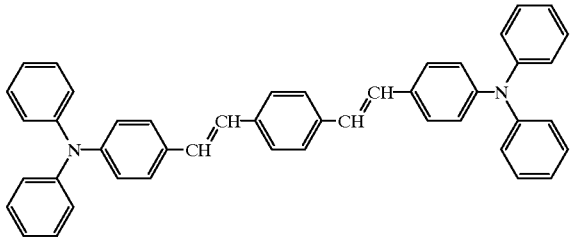

was obtained (yield: 68%, melting point: 206° C.).

Synthesis Comparative Example 2

In the same manner as in Synthesis Example 2 except for using 0.011 moles (4.4 g) of 4,4'-dimethyl-4"-(4-formylstyryl)-triphenylamine in place of 2-ethyl-6-methyl-4'-(4-formylstyryl)-triphenylamine phosphate, 4.9 g of a stilbene derivative represented by the following general formula (35):

(35)

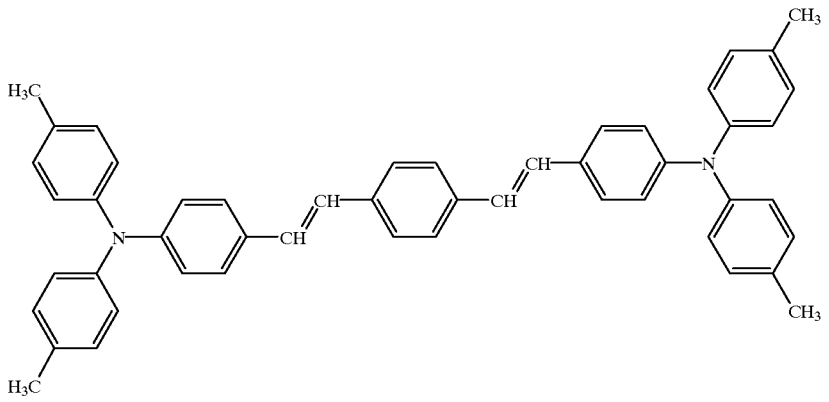

was obtained (yield: 66%, melting point: 208° C.).

Synthesis Comparative Example 3

In the same manner as in Synthesis Example 2 except for using 0.011 moles (4.4 g) of 4-ethyl-3',3"-methyl-4"-(4-formylstyryl)-triphenylamine in place of 2-ethyl-6-methyl-4'-(4-formylstyryl)-triphenylamine phosphate, 5.3 g of a stilbene derivative represented by the following general formula (36):

(36)

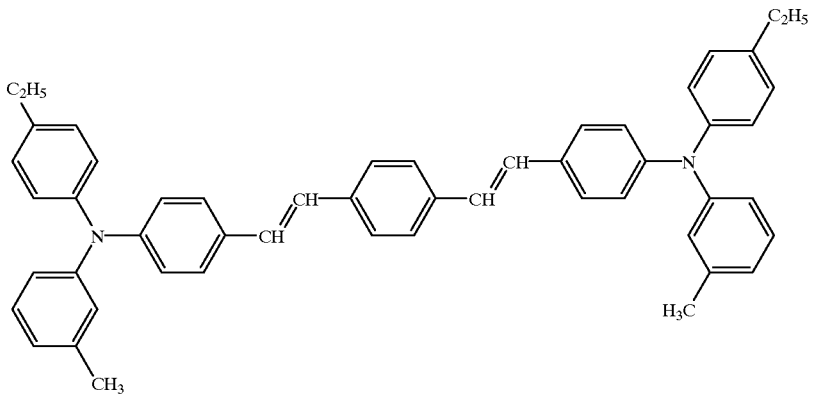

was obtained (yield: 67%, melting point: 228° C.).

<<Production of electrophotosensitive material>>

Example 1

5 Parts by weight of a X type metal-free phthalocyanine (CG1) as the electric charge generating material, 100 parts by weight of polycarbonate as the binder resin, 800 parts by weight of tetrahydrofuran as the solvent and a stilbene derivative corresponding to the compound No. (1-29) in Table 1 as the hole transferring material were mixed and dispersed using a ball mill for 50 hours to prepare a coating solution for single-layer type photosensitive layer. Then, an alumina tube was coated with the coating solution by a dip coating method, followed by hot-air drying at 100° C. for 30 minutes to form a photosensitive layer having a film thickness of 25 μm, thus producing a single-layer type electrophotosensitive material.

Example 2

In the same manner as in Example 1 except for using a stilbene derivative corresponding to the compound No. (1-23) in Table 1 as the hole transferring material, a single-layer type electrophotosensitive material was produced.

Example 3

In the same manner as in Example 1 except for using a stilbene derivative corresponding to the compound No. (1-30) in Table 1 as the hole transferring material, a single-layer type electrophotosensitive material was produced.

Example 4

In the same manner as in Example 1 except for using a stilbene derivative corresponding to the compound No. (1-22) in Table 1 as the hole transferring material, a single-layer type electrophotosensitive material was produced.

Example 5

In the same manner as in Example 1 except for using a stilbene derivative corresponding to the compound No. (1-2) in Table 1 as the hole transferring material, a single-layer type electrophotosensitive material was produced.

Comparative Example 1

In the same manner as in Example 1 except for using a stilbene derivative represented by the general formula (34)

as the hole transferring material, a single-layer type electrophotosensitive material was produced.

Comparative Example 2

In the same manner as in Example 1 except for using a stilbene derivative by the general formula (35) as the hole transferring material, a single-layer type electrophotosensitive material was produced.

Comparative Example 3

In the same manner as in Example 1 except for using a stilbene derivative by the general formula (36) as the hole transferring material, a single-layer type electrophotosensitive material was produced.

<<Evaluation of compatibility with binder resin>>

The compatibility with the binder resin was evaluated by the surface state of the single-layer type photosensitive material produced as described above. Specifically, the presence or absence of agglomeration and crystallization of the surface of the photosensitive layer of the photosensitive materials produced in Examples and Comparative Examples were relatively judged.

<<Evaluation test of electric characteristics>>

Using a drum sensitivity tester (manufactured by GENTEC Co.), a voltage was applied on the surface of each photosensitive material of Examples and Comparative Examples to charge the surface at +700 V±20 V and an initial surface potential $V_o$ (V) was measured. Then, monochromic light having a wavelength of 780 nm (half-width: 20 nm, light intensity I: 16 $\mu$W/cm$^2$) from white light of a halogen lamp as an exposure light source through a band-pass filter was irradiated on the surface of each photosensitive material (irradiation time: 80 mseconds) and the time required to reduce the above surface potential $V_o$ to half was measured and a half-life exposure $E_{1/2}$ ($\mu$J/cm$^2$) was calculated. Furthermore, a surface potential at the time at which 330 mseconds have passed since the beginning of exposure was measured as a residual potential $V_r$ (V).

The charging and exposure were repeated 1000 times in the same manner as that described above and the half-life exposure $E_{1/2}$ (1000) ($\mu$J/cm$^2$) and residual potential $V_r$ (1000) (V) in 1000th repeat were measured, and then a difference in half-life exposure $E_{1/2}$ and a difference in residual potential $V_r$, $\Delta E_{1/2}$ (=$E_{1/2}$ (1000)−$E_{1/2}$) and $\Delta V_r$ (=$V_r$ (1000)−$V_r$) were calculated.

Kinds of the electric charge generating material, hole transferring material, electron transferring material and electron acceptor used in the above respective Examples and Comparative Examples, and the measurement results of the half-life exposure $E_{1/2}$, residual potential $V_r$, $\Delta E_{1/2}$ and $\Delta V_r$ are shown in Table 2.

The explanatory notes on each mark in Table 2 are given below.

(○: the standard level)

⊙: No crystallization on the surface of the photosensitive layer, aggregation is less than the standard level (rarely observed).

○: No crystallization on the surface of the photosensitive layer, aggregation is not appreciably observed.

Δ: crystallizations are observed on the surface of the photosensitive layer, aggregations are more than the standard level.

X: Crystallizations are remarkably observed on the surface of the photosensitive layer, aggregations occur to a great extent.

TABLE 2

| | Type of photosensitive material | Electric charge generating material | Hole transferring material | Half-life exposure $E_{1/2}$ ($\mu$J/cm$^2$) | Residual potential $V_r$ (V) | Difference in half-life exposure $\Delta E_{1/2}$ ($\mu$J/cm$^2$) | Difference in residual potential $\Delta V_r$ (V) | Compatibility |
|---|---|---|---|---|---|---|---|---|
| Example 1 | Single layer | CG1 | 1-29 | 0.68 | 101 | 0.02 | 1 | ⊙ |
| Example 2 | Single layer | CG1 | 1-23 | 0.62 | 91 | 0.01 | 0 | ⊙ |
| Example 3 | Single layer | CG1 | 1-30 | 0.64 | 98 | 0.02 | 1 | ⊙ |
| Example 4 | Single layer | CG1 | 1-22 | 0.69 | 112 | 0.02 | 1 | ⊙ |
| Example 5 | Single layer | CG1 | 1-2 | 0.67 | 96 | 0.04 | 3 | ○ |
| Comp. Example 1 | Single layer | CG1 | 34 | impossible to measure because of crystallization of photosensitive layer | | | | X |
| Comp. Example 2 | Single layer | CG1 | 35 | impossible to measure because of crystallization of photosensitive layer | | | | X |
| Comp. Example 3 | Single layer | CG1 | 36 | 1.14 | 179 | 0.270 | 33 | Δ |

The disclosure of Japanese Patent Application No. 11-277048, filed on Sep. 29, 1999, is incorporated herein by reference.

What is claimed is:

1. A stilbene derivative wherein molecular structures of triphenylamino groups located at both sides of a benzene ring in a molecular center are unsymmetric with respect to the benzene ring.

2. The stilbene derivative according to claim 1, which is represented by the general formula (1):

(1)

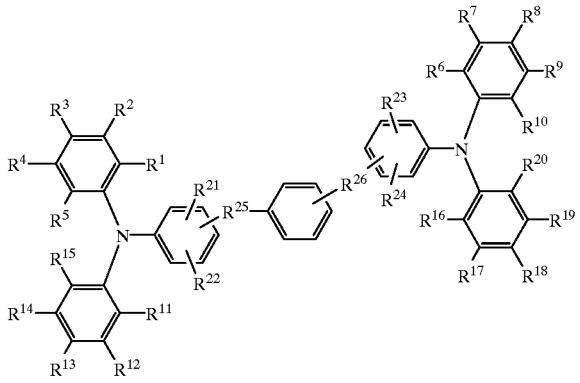

wherein $R^1$ to $R^{24}$ are the same or different and each represents an optionally substituted alkyl group, an optionally substituted alkoxy group, an optionally substituted aryl group, an optionally substituted aralkyl group, a hydrogen atom, or a nitro group; $R^{25}$ and $R^{26}$ each represents a vinylene group; at least one of the pairs of a combination of $R^n$ and $R^{n+5}$ and a combination of $R^m$+$R^{m+2}$ represent different substituents; at least two substituents of the group consisting of $R^1$ to $R^5$, $R^6$ to $R^{10}$ $R^{11}$ to $R^{15}$, and $R^{16}$ to $R^{20}$ represent a hydrogen atom; n represents an integer of 1 to 10; and m represents 21 or 22.

3. The stilbene derivative according to claim 2, wherein at least one of the pairs of $R^{21}$ and $R^{23}$, $R^{22}$ and $R^{24}$, and $R^{25}$ and $R^{26}$ represent different substitution positions from that of a nitrogen atom attached through a benzene ring.

4. The stilbene derivative according to claim 2, wherein at least one of $R^1$ and $R^6$, $R^{11}$ and $R^{16}$ represent an optionally substituted alkyl group, an optionally substituted alkoxy group, an optionally substituted aryl group, and an optionally substituted aralkyl group.

5. The stilbene derivative according to claim 1, which is represented by the general formula (2):

(2)

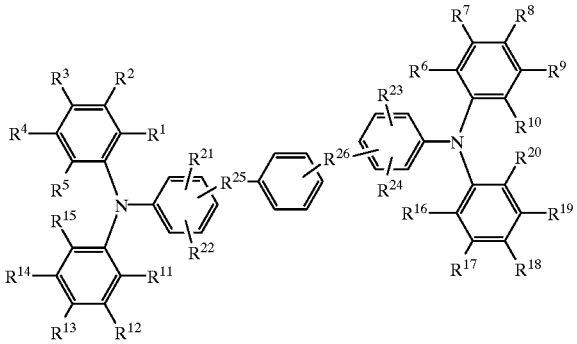

wherein $R^1$ to $R^{24}$ are the same or different and each represents an optionally substituted alkyl group, an optionally substituted alkoxy group, an optionally substituted aryl group, an optionally substituted aralkyl group, a hydrogen atom, or a nitro group; $R^{25}$ and $R^{26}$ each represents a vinylene group; $R^n$ and $R^{n+5}$ each represents the same group; $R^m$ and $R^{m+2}$ each represents the same group; at least one of the pairs of $R^{21}$ and $R^{23}$, $R^{22}$ and $R^{24}$, and $R^{25}$ and $R^{26}$ represent different substitution positions from that of a nitrogen atom attached through a benzene ring; n represents an integer of 1 to 10; and m represents 21 or 22.

6. The stilbene derivative according to claim 5, wherein at least one of $R^1$, $R^6$, $R^{11}$ and $R^{16}$ is an optionally substituted alkyl group, an optionally substituted alkoxy group, an optionally substituted aryl group, or an optionally substituted aralkyl group.

7. A method of producing the stilbene derivative of claim 2, which comprises reacting an aldehyde derivative represented by the general formula (3):

(3)

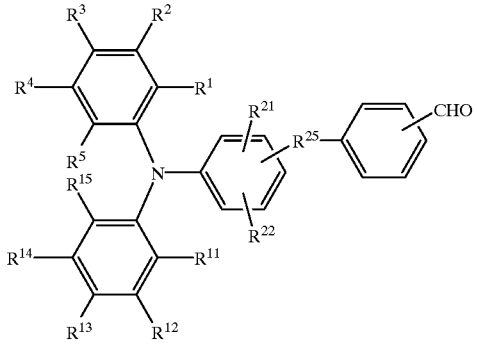

wherein $R^1$ to $R^5$, $R^{11}$ to $R^{15}$, $R^{21}$, $R^{22}$ and $R^{25}$ are as defined in the general formula (1), with a triphenylamine phosphate derivative represented by the general formula (4):

(4)

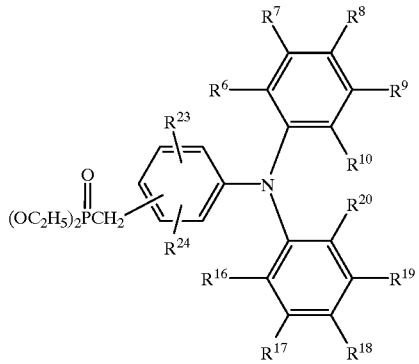

wherein $R^6$ to $R^{10}$ $R^{16}$ to $R^{20}$, $R^{23}$ and $R^{24}$ are as defined in the general formula (1).

8. A method of producing the stilbene derivative of claim 2, which comprises reacting a formylated triphenylamine derivative represented by the general formula (5):

(5)

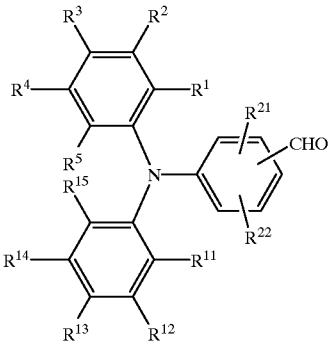

wherein $R^1$ to $R^5$, $R^{11}$ to $R^{15}$, $R^{21}$ and $R^{22}$ are as defined in the general formula (1), with a monostilbene derivative represented by the general formula (6):

(6)

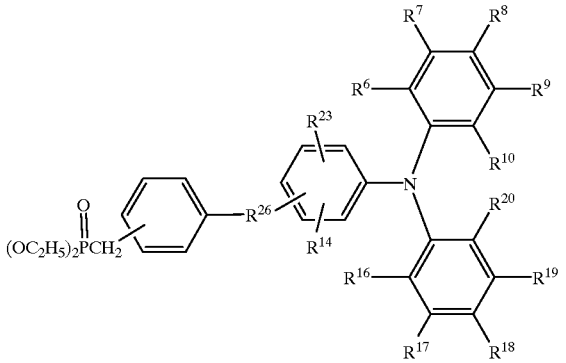

wherein $R^6$ to $R^{10}$, $R^{16}$ to $R^{20}$, $R^{23}$, $R^{24}$ and $R^{26}$ are as defined in the general formula (1).

9. A method of producing the stilbene derivative of claim 5, which comprises reacting an aldehyde derivative represented by the general formula (3):

(3)

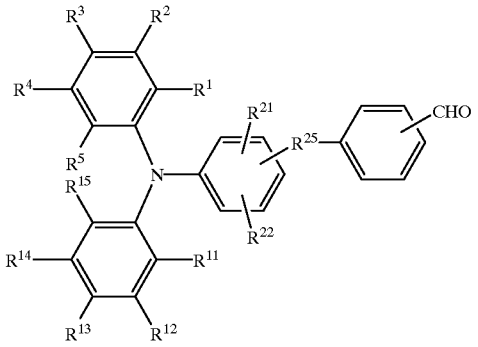

wherein $R^1$ to $R^5$, $R^{11}$ to $R^{15}$, $R^{21}$, $R^{22}$ and $R^{25}$ are as defined in the general formula (1), with a triphenylamine phosphate derivative represented by the general formula (4):

(4)

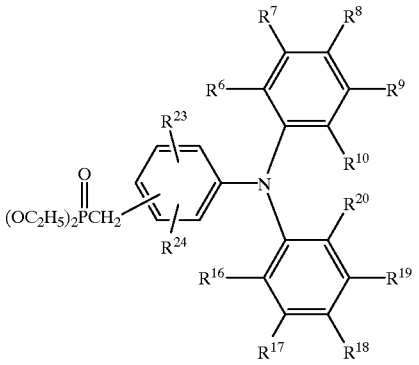

wherein $R^6$ to $R^{10}$, $R^{16}$ to $R^{20}$, $R^{23}$ and $R^{24}$ are as defined in the general formula (1).

10. A method of producing the stilbene derivative of claim 5, which comprises reacting a formylated triphenylamine derivative represented by the general formula (5):

(5)

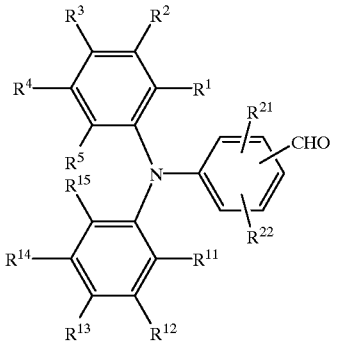

wherein $R^1$ to $R^5$, $R^{11}$ to $R^{15}$, $R^{21}$ and $R^{22}$ are as defined in the general formula (1), with a monostilbene derivative represented by the general formula (6):

(6)

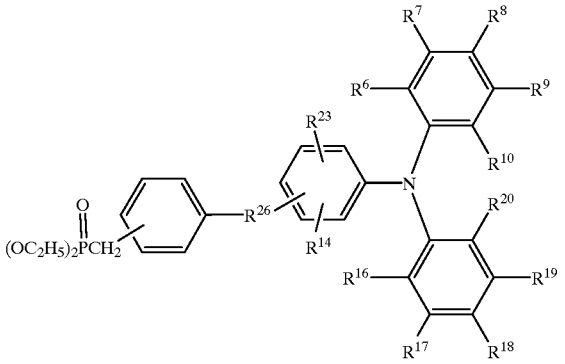

wherein $R^6$ to $R^{10}$, $R^{16}$ to $R^{20}$, $R^{23}$, $R^{24}$ and $R^{26}$ are as defined in the general formula (1).

11. An electrophotosensitive material comprising a conductive substrate and a photosensitive layer formed on the substrate, the photosensitive layer containing at least one of the stilbene derivatives of claim 1.

12. An electrophotosensitive material comprising a conductive substrate and a photosensitive layer formed on the substrate, the photosensitive layer containing at least one of the stilbene derivatives of claim 2.

13. An electrophotosensitive material comprising a conductive substrate and a photosensitive layer formed on the substrate, the photosensitive layer containing at least one of the stilbene derivatives of claim 3.

14. The electrophotosensitive material according to the claim 11, wherein the photosensitive layer is a single-layer type photosensitive layer containing an electric charge generating material.

15. The electrophotosensitive material according to the claim 12, wherein the photosensitive layer is a single-layer type photosensitive layer containing an electric charge generating material.

16. The electrophotosensitive material according to the claim 13, wherein the photosensitive layer is a single-layer type photosensitive layer containing an electric charge generating material.

17. The electrophotosensitive material according to claim 14, wherein the electric charge generating material is one or more member selected from the group consisting of a metal-free phthalocyanine, a metal phthalocyanine, a perylene pigment and a bisazo pigment.

18. The electrophotosensitive material according to claim 15, wherein the electric charge generating material is one or more member selected from the group consisting of a metal-free phthalocyanine, a metal phthalocyanine, a perylene pigment and a bisazo pigment.

19. The electrophotosensitive material according to claim 16, wherein the electric charge generating material is one or more member selected from the group consisting of a metal-free phthalocyanine, a metal phthalocyanine, a perylene pigment and a bisazo pigment.

* * * * *